US012442621B2

(12) United States Patent
Niswander et al.

(10) Patent No.: US 12,442,621 B2
(45) Date of Patent: Oct. 14, 2025

(54) FIREARM SIGHT MOUNTING PLATE ASSEMBLY

(71) Applicant: AGENCY ARMS, LLC, Caldwell, ID (US)

(72) Inventors: Randy Paul Niswander, Oxnard, CA (US); Michael Lee Parks, Eagle, ID (US)

(73) Assignee: AGENCY ARMS, LLC, Ventura, CA (US)

( * ) Notice: Subject to any disclaimer, the term of this patent is extended or adjusted under 35 U.S.C. 154(b) by 0 days.

(21) Appl. No.: 18/438,585

(22) Filed: Feb. 12, 2024

(65) Prior Publication Data

US 2024/0183636 A1 Jun. 6, 2024

Related U.S. Application Data

(63) Continuation of application No. 17/499,084, filed on Oct. 12, 2021, now Pat. No. 11,933,583.

(60) Provisional application No. 63/109,770, filed on Nov. 4, 2020.

(51) Int. Cl.
*F41G 1/26* (2006.01)

(52) U.S. Cl.
CPC ..... *F41G 1/26* (2013.01)

(58) Field of Classification Search
CPC ..... F41G 1/26; F41G 11/003
USPC ..... 42/126, 127, 124, 125
See application file for complete search history.

(56) References Cited

U.S. PATENT DOCUMENTS

| | | | |
|---|---|---|---|
| 4,628,611 | A | 12/1986 | Ruffino |
| 5,467,552 | A | 11/1995 | Cupp et al. |
| 6,327,806 | B1 | 12/2001 | Paige |
| 7,765,731 | B1 | 8/2010 | Liebig |
| 8,011,130 | B2 | 9/2011 | Chang |
| 8,832,983 | B1 | 9/2014 | Wolf |
| 8,893,422 | B2 | 11/2014 | Wolf |
| 9,062,936 | B2 | 6/2015 | Zimmer |
| 9,267,759 | B2 | 2/2016 | Speroni |
| 9,506,726 | B2 | 11/2016 | Wolf |
| 9,587,911 | B2 | 3/2017 | Wolf |
| 9,958,234 | B2 | 5/2018 | Campean |
| 10,024,628 | B2 | 7/2018 | Toner et al. |
| 10,036,613 | B2 | 7/2018 | Huff |

(Continued)

OTHER PUBLICATIONS

ATEI, Works in Progress, Trijicon, Inc., Dec. 1, 2011 (one page).

(Continued)

*Primary Examiner* — John Cooper
(74) *Attorney, Agent, or Firm* — Eversheds Sutherland (US) LLP

(57) ABSTRACT

A firearm mounting plate assembly is provided. The firearm mounting plate assembly includes a firearm slide with a first side, a second side, and a top side. A recess defined by a first slide wall, a second slide wall, and a recess base surface is disposed on the firearm slide top side. The recess includes a rib, a slot, and an ejector projection. The firearm mounting plate assembly includes a mounting plate with a top surface, a bottom surface, a front side, and a rear side. An ejector notch and a channel is disposed along the bottom surface. The mounting plate includes a stud, and one or more bosses. The mounting plate is configured to secure within the recess of the firearm slide.

17 Claims, 27 Drawing Sheets

(56) References Cited

U.S. PATENT DOCUMENTS

| | | | | |
|---|---|---|---|---|
| RE47,335 | E | 4/2019 | Wolf | |
| 10,352,654 | B2 | 7/2019 | Costet et al. | |
| 10,663,254 | B1 | 5/2020 | Molcho | |
| 10,753,710 | B2 | 8/2020 | Niswander et al. | |
| 11,112,214 | B2 | 9/2021 | Niswander | |
| 11,280,587 | B2 | 3/2022 | Niswander et al. | |
| 2007/0234625 | A1 | 10/2007 | Kidd | |
| 2008/0216379 | A1* | 9/2008 | Javorsky | F41G 1/345 42/115 |
| 2013/0111799 | A1 | 5/2013 | Lee et al. | |
| 2013/0283660 | A1 | 10/2013 | Matthews | |
| 2014/0053445 | A1* | 2/2014 | Wolf | F41G 1/00 42/2 |
| 2014/0150325 | A1 | 6/2014 | Keng et al. | |
| 2014/0230305 | A1* | 8/2014 | Zimmer | F41C 3/00 42/111 |
| 2015/0198415 | A1 | 7/2015 | Campean | |
| 2015/0241175 | A1* | 8/2015 | Wolf | F41G 11/005 42/124 |
| 2015/0253090 | A1 | 9/2015 | Kirchoff | |
| 2017/0059277 | A1 | 3/2017 | Justic | |
| 2017/0184375 | A1 | 6/2017 | Huff | |
| 2018/0087871 | A1* | 3/2018 | Toner | F41G 1/16 |
| 2019/0049217 | A1 | 2/2019 | Costet et al. | |
| 2019/0257620 | A1* | 8/2019 | Zimmer | F41C 3/00 |
| 2019/0331461 | A1 | 10/2019 | Zimmer | |
| 2020/0025520 | A1* | 1/2020 | Niswander | F41G 11/003 |
| 2020/0232601 | A1* | 7/2020 | Chavez | F16M 11/041 |
| 2021/0348882 | A1 | 11/2021 | Niswander et al. | |
| 2022/0316801 | A1 | 10/2022 | Chen et al. | |

OTHER PUBLICATIONS

GW Leupold Deltapoint Cut, https://web.archive.org/web/20110104073915/http://www.glockworx.com:80/Products.aspx?CAT=3699, Jan. 2011 (3 pp.).

Matt, "Dueck Defense RBU", Sep. 26, 2015, Jerking the Trigger, Online Article, All Pages <https://jerkingthetrigger.com/2015/09/26/dueck-defense-rbu/>. (Year:2015).

Moden Weapon Concepts, "Pistol Red Dot Mounting Alternative: Dueck Defense RBU (Trijicon RMR)", Mar. 3, 2016, YouTube, Online Video, Entire Video, <https://www.youtube.com/watch?v=0Jdb0ohwMTc>. (Year: 2016).

Goteron, N/A, lightfighter.net (image of unity tactical device), Feb. 1, 2012 (1 page).

* cited by examiner (4A)

(12)

FIREARM SIGHT MOUNTING PLATE ASSEMBLY

CROSS-REFERENCE TO RELATED APPLICATIONS

The present application is a continuation of U.S. Non-provisional application Ser. No. 17/499,084, filed Oct. 12, 2021, which claims the benefit of U.S. Provisional Patent Application No. 63/109,770, filed Nov. 4, 2020, which is hereby incorporated by reference herein in their entireties.

TECHNICAL FIELD

The present application relates generally to firearm sight mounting plates.

BACKGROUND

Red dot sights have become more and more prevalent for firearms. Red dot sights provide an illuminated aiming dot that is parallax free. As may be desired from time to time, the configuration of a red dot sight on a firearm may vary based on personal preference and/or application. For instance, in some configurations, the red dot is in front of the rear iron sight. In other configurations, the red dot sight may be behind the rear iron sight. Yet further, in some configurations, the iron sight may be removed (e.g., not present) or may be the only sight coupled to the firearm. In still other configurations, suppressor height iron sights may be utilized. However, if a shooter wants to change from one configuration to another, or from one red dot sight to another, such change may be difficult, time-consuming, require special tools, and/or not possible.

BRIEF DESCRIPTION OF THE DRAWINGS

The detailed description is set forth with reference to the accompanying drawings illustrating examples of the disclosure, in which use of the same reference numerals indicates similar or identical items. Certain examples of the present disclosure may include elements, components, and/or configurations other than those illustrated in the drawings, and some of the elements, components, and/or configurations illustrated in the drawings may not be present in certain examples.

DETAILED DESCRIPTION

The present disclosure provides for a firearm sight mounting plate assembly, which includes a mounting plate (also referred to herein as a firearm sight mounting plate) and a firearm slide with a recess configured to receive the mounting plate. In this manner, the size, shape, and configuration of the recess may correspond to the size, shape, and configuration of the mounting plate. The mounting plate may be adapted to mount several different types of red dot sights and/or iron sights thereon. The mounting plate may be a universal mount for different red dot sights, such as Trijicon® sights, TRUGLO® sights, Burris® sights, or sights from other manufacturers. For example, the mounting plate may include one or more apertures by which fasteners penetrate through the mounting plate into the firearm slide to secure the mounting plate to the firearm slide. The mounting plate may have a plurality of protrusions and/or apertures configured to further secure a red dot sight onto the mounting plate. The mounting plate may also have a dovetail slot or other mounting feature for receiving a rear iron sight. In some instances, the dovetail slot may be on the front side or rear side of the mounting plate. In some instances, the rear iron sight may be positioned in front of or behind the red dot sight. In other instances, the red dot sight may be omitted, and the mounting plate may only include an iron sight mounted thereto. In some instances, the mounting plate may be configured to be quickly removed from the recess of the firearm slide.

The disclosure now will be described more fully hereinafter with reference to the accompanying drawings, in which exemplary embodiments are shown. The concepts discussed herein may, however, be embodied in many different forms and should not be construed as limited to the examples set forth herein; rather, these examples are provided so that this disclosure will be thorough and complete, and will fully convey the scope to those of ordinary skill in the art. Like numbers refer to like, but not necessarily the same or identical, elements throughout.

Firearm Slide

Figure 1A:
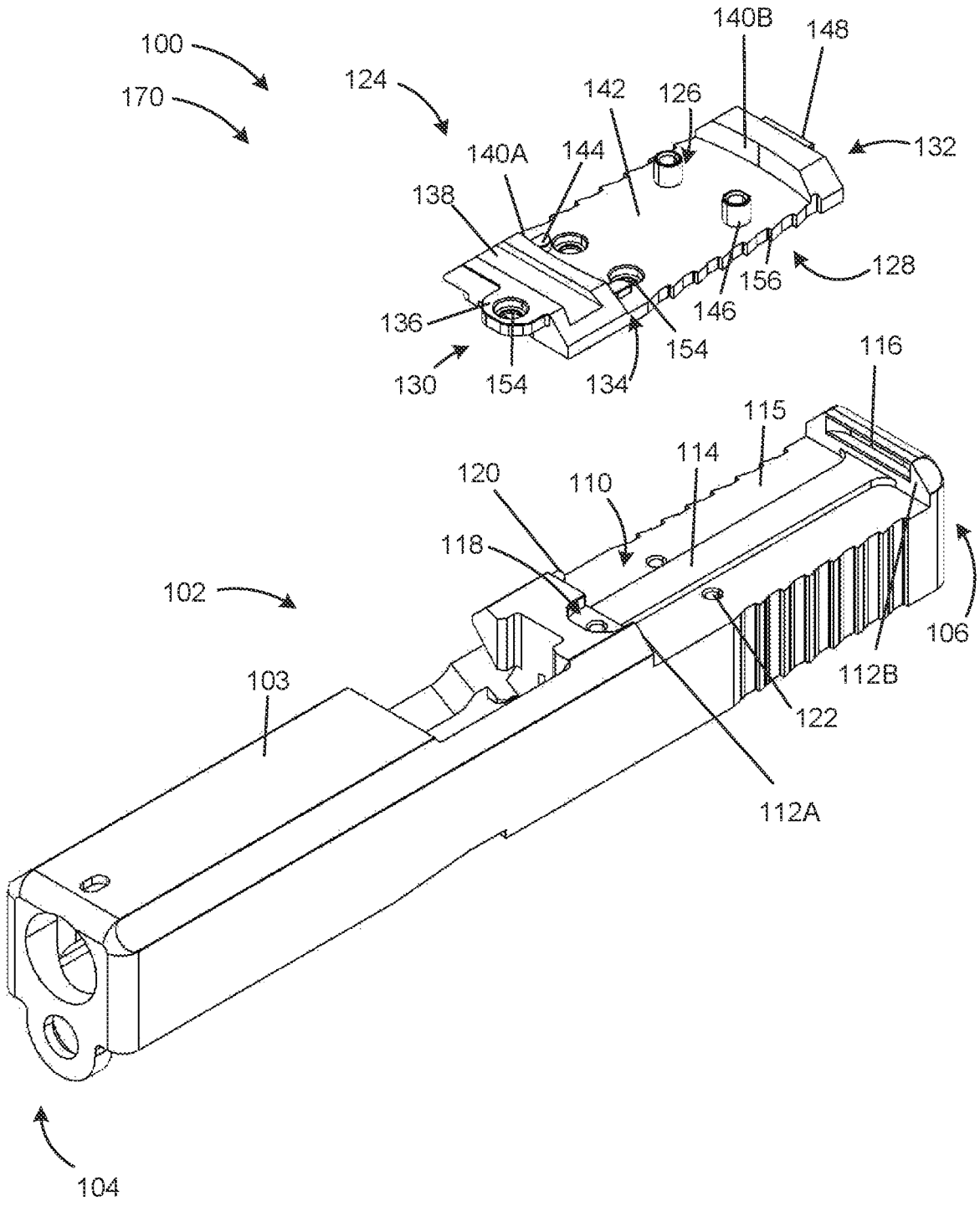
FIG. 1A is a perspective view of a firearm sight mounting plate assembly in a disengaged position according to one or more examples of the disclosure.
Figure 1B:
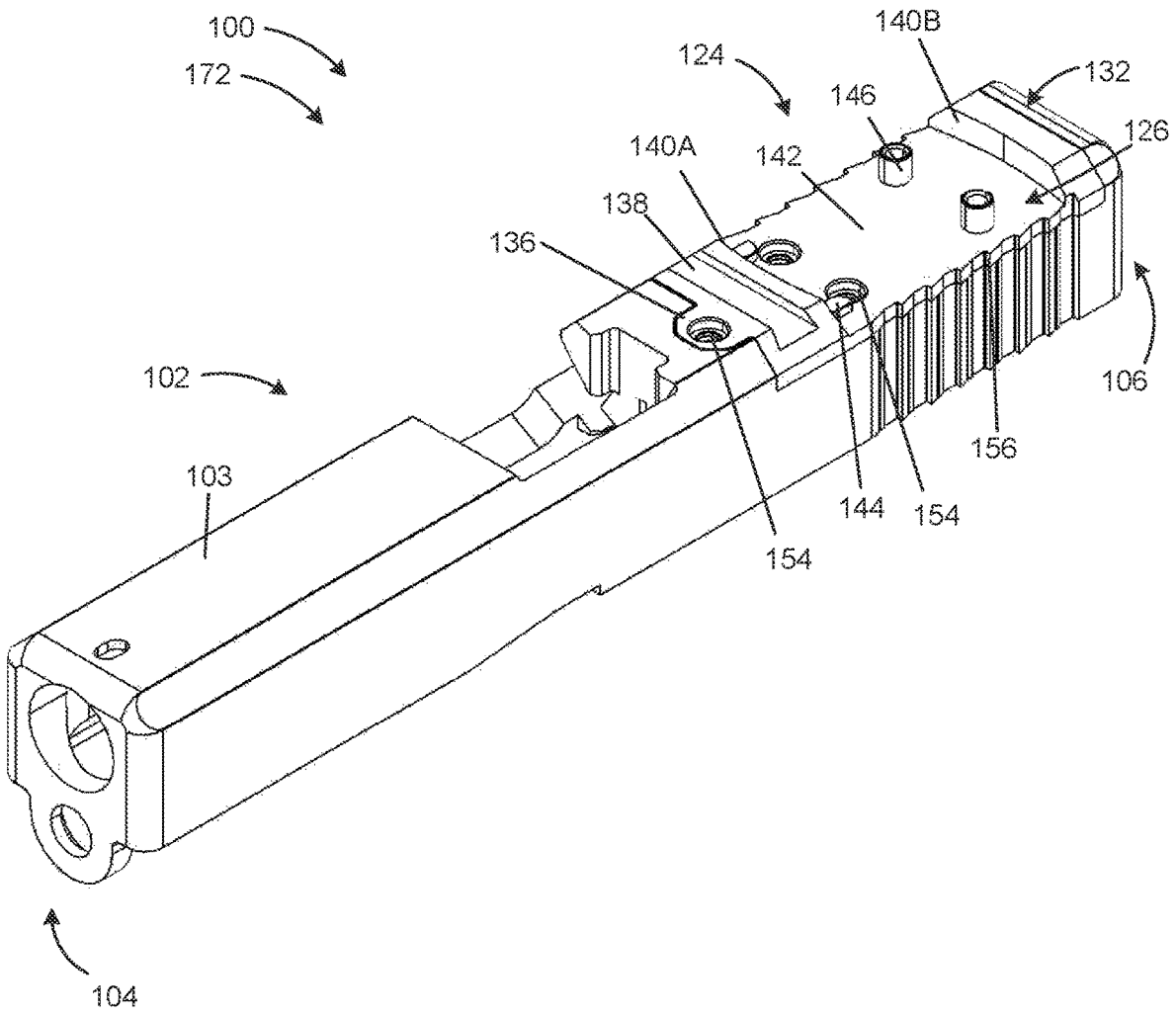
FIG. 1B is a perspective view of the firearm sight mounting plate assembly in an engaged position according to one or more examples of the disclosure.
Figure 2:
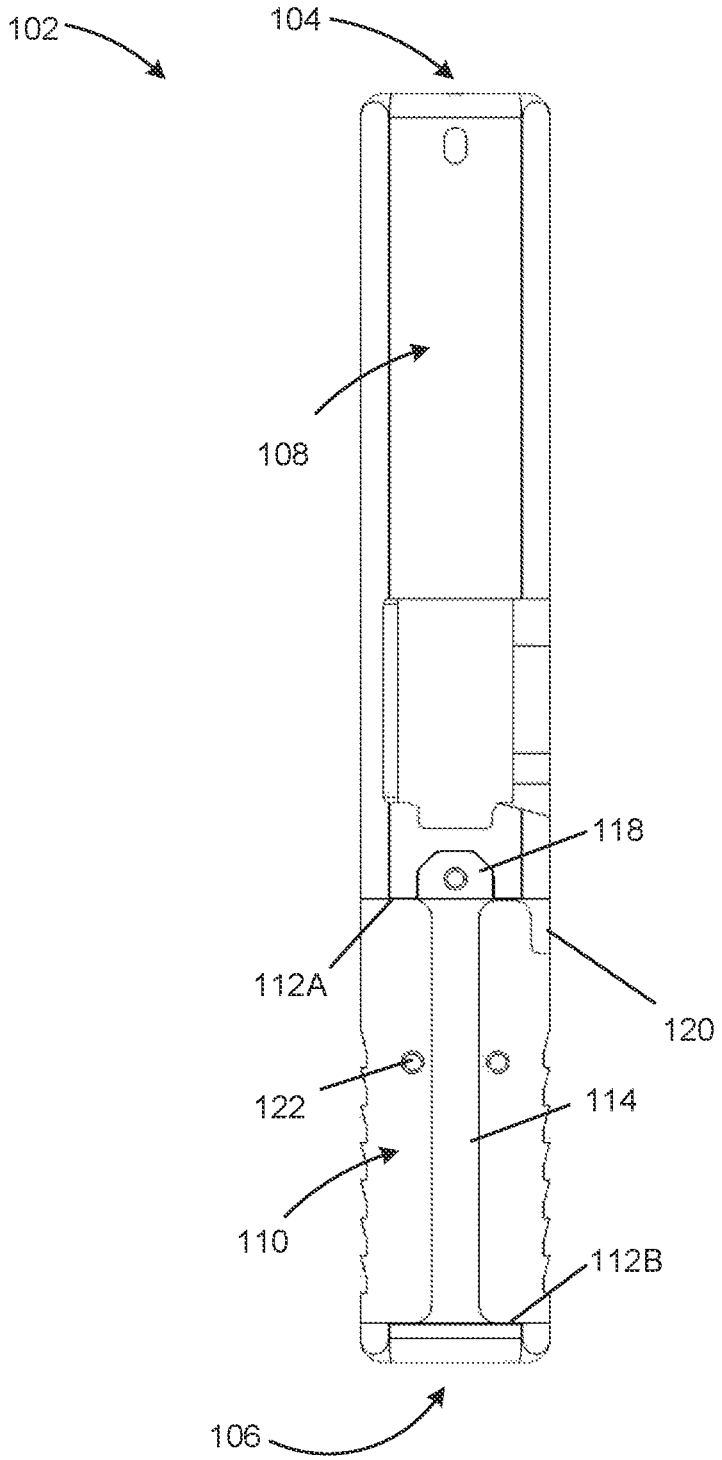
FIG. 2 is a top view of the firearm slide according to one or more examples of the disclosure.

FIG. 1A is a perspective view of a firearm sight mounting plate assembly in a disengaged position according to one or more examples of the disclosure. FIG. 1B is a perspective view of the firearm sight mounting plate assembly in an engaged position according to one or more examples of the disclosure. FIG. 2 is a top view of the firearm slide according to one or more examples of the disclosure. Referring to FIGS. 1A-2, a firearm slide 102 has a recess 110 configured to accept a mounting plate 100. In certain examples, the firearm slide 102 includes an exterior surface 103 with a first side 104 and a second side 106. On a top side 108 of the firearm slide 102, between the first side 104 and the second side 106, the recess 110 is disposed towards the second side 106. The recess 110 can be a recessed surface along the plane of the top side 108 of the firearm slide 102.

The recess 110 of the firearm slide 102 includes a pair of slide walls 112A/112B (e.g., a first slide wall 112A and a second slide wall 112B) disposed opposite to one another. In one example, the slide walls 112A/112B are parallel to one another and form a rectangular indention with the recess 110. Adjacent to the first slide wall 112A is a catch 118. The catch 118 can be an indented surface to the firearm slide 102 similar to the recess 110. The catch 118 may be disposed below the top surface of the firearm and above the recess 110. The catch 118 can be substantially semi-circular in some instances. In other instances, the catch 118 can be rectangular, triangular, or some other geometric shape. The catch 118 can be offset from the center along the exterior surface 103. The catch 118 may be centered along the exterior surface 103.

Adjacent to the catch 118 and extending to the second slide wall 112B can be a rib 114 disposed within the recess 110. The rib 114 can run between the first slide wall 112A and the second slide wall 112B. The rib 114 can be a raised surface from a recess base surface 115 configured to correspond to a later discussed surface of a mounting plate 124. In other examples, the rib 114 may extend in a variety of other directions and/or take other shapes, such as a square, circle, triangle, etc., or a combination shape.

Adjacent to the rib 114, and disposed on the second slide wall 112B, can be a slot 116. The slot 116 can be an indented surface disposed into the second slide wall 112B. In other examples, the rib 114, the slot 116, and the catch 118 can be interchangeably disposed on or between the first slide wall 112A and the second slide wall 112B.

In some examples, the recess 110 can include an ejector projection 120 and one or more sockets 122 disposed in the recess 110. The ejector projection 120 can be adjacent to the rib 114, and similar to the rib 114, the ejector projection 120 can mimic a later discussed surface of the mounting plate 124. For example, the ejector projection 120 may fit within a complementary ejector notch 150 (see, e.g., FIG. 3F) on the bottom surface 128 of the mounting plate 124. Each of the rib 114 and the ejector projection 120 can stabilize the mounting plate 124 so as to disallow lateral movement whether the firearm is discharged or is static. Additionally, an advantage of the rib 114 and the ejector projection 120 can be to help align the mounting plate 124 between the first side 104 and the second side 106 of the firearm slide 102. The rib 114 may be raised at a variety of heights from the base surface 115 of the recess 110 of the firearm slide 102. In some instances, the rib 114 may be raised above the recess 110 to protect the striker channel within the firearm slide 102. In other examples, the rib 114 can be omitted.

In some examples, the sockets 122 can be disposed throughout and adjacent to the recess 110. The sockets 122 can be configured to receive one or more fasteners (e.g., threaded). For example, as shown in FIG. 1A, the recess 110 and the catch 118 can include one or more sockets 122. The recess 110 can have a socket 122 disposed on each side of the rib 114, and the catch 118 can have a socket 122 disposed on one surface. In this manner, once the mounting plate 124 is set within the recess 110, one or more fasteners can engage each socket 122 through the mounting plate 124.

In some instances, the recess 110 can be substantially rectangular. For example, the two opposed slide walls 112A/112B extend at a 90-degree angle from the recess base surface 115 towards the top side 108 of the firearm slide 102. In other examples, the recess 110 may be circular, triangular, or some other geometric shape. The slide walls 112A/112B may angle from the recess base surface 115 between 1 degree to 179 degrees. In other examples, the slide walls 112A/112B may include an arced surface. The slide walls 112A/112B may be at the same angle. In some instances, the recess base surface 115 may be parallel (or co-planar) with the barrel hood of the firearm along the top side 108 of the firearm slide 102. In other instances, the recess base surface 115 may be angled towards or away from the barrel hood of the firearm.

As shown between FIGS. 1A and 1B, the firearm plate mounting assembly 100 can alter between a disengaged position 170 and an engaged position 172. In the disengaged position 170, the mounting plate 124 (or any mounting plate embodiment shown or described herein) can lower into the recess 110 to secure onto the slide 102. FIG. 1B depicts the engaged position 172 of the mounting plate 124 and the slide 102.

Mounting Plate

FIGS. 3A-3F depicts various views of a mounting plate 124 configured to secure into the firearm slide recess 110. In one example, the mounting plate 124 includes a top surface 126, an opposed bottom surface 128, a front side 130, and a rear side 132. Each surface may be configured for several purposes, including temporarily or permanently attaching the mounting plate 124 to a firearm or optic. As described below, the mounting plate 124 is configured to mount to a firearm slide 102. For example, the bottom surface 128 may be disposed within the recess 110 of the slide 102 and abut the base surface 115 of the recess 110. The mounting plate 124 enables a user to quickly change red dot sights and/or iron sights, and/or the configuration of the two (e.g., which is in front of the other), on a firearm slide 102.

Figure 3A:
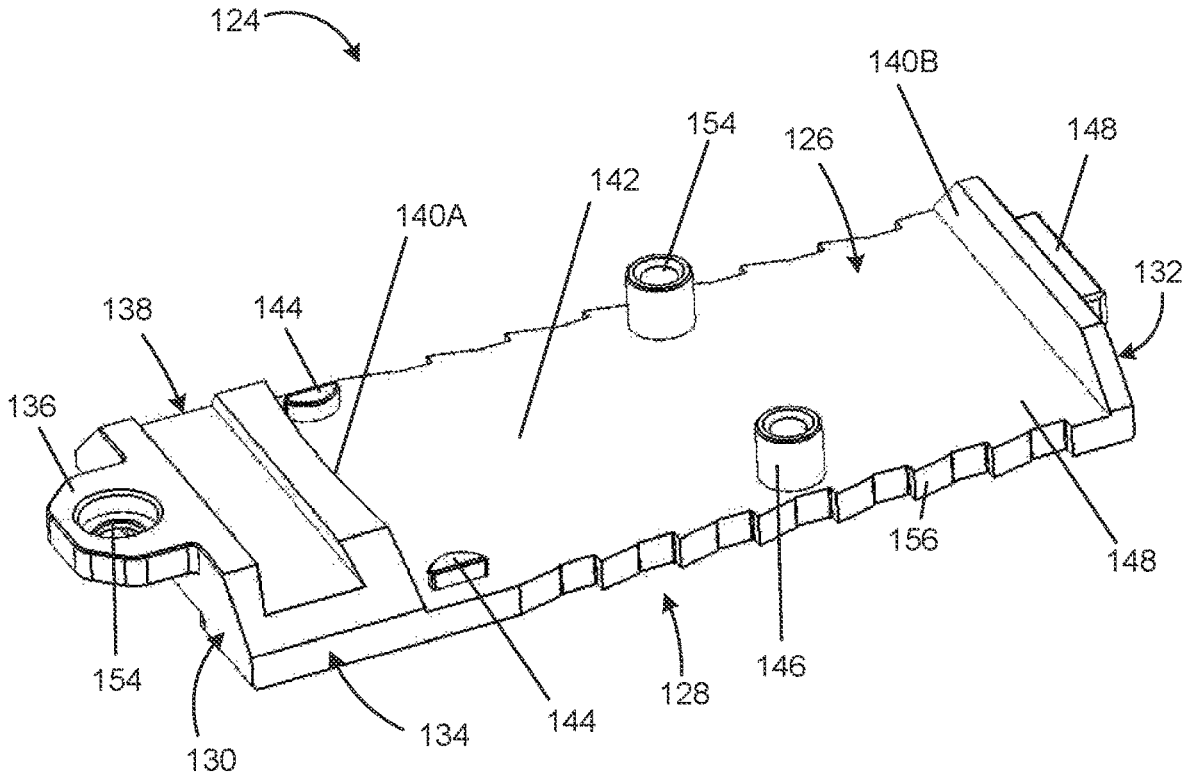
FIG. 3A is a perspective view of a mounting plate of the firearm slide assembly according to one or more examples of the disclosure.
Figure 3B:
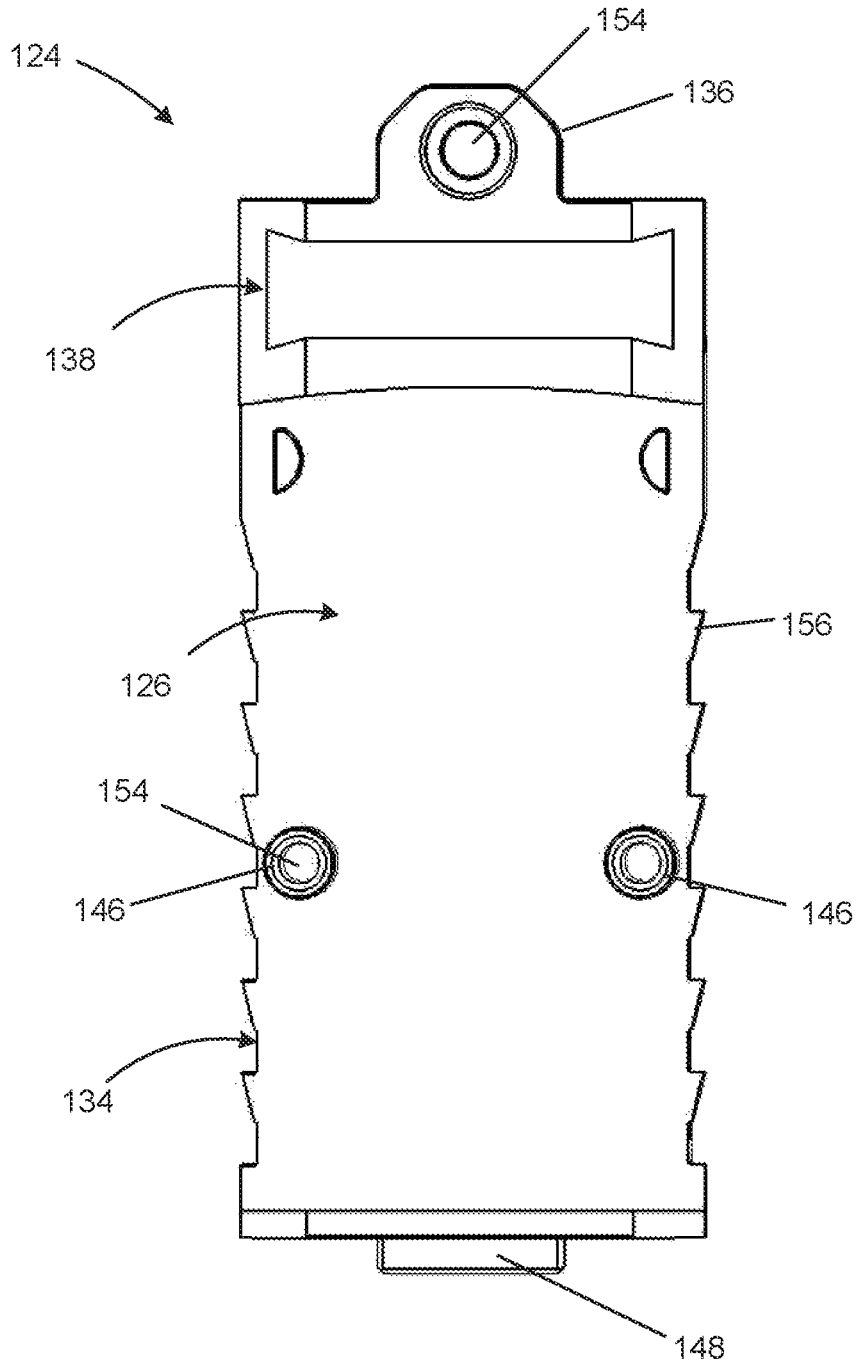
FIG. 3B is a top view of the mounting plate according to one or more examples of the disclosure.
Figure 3C:
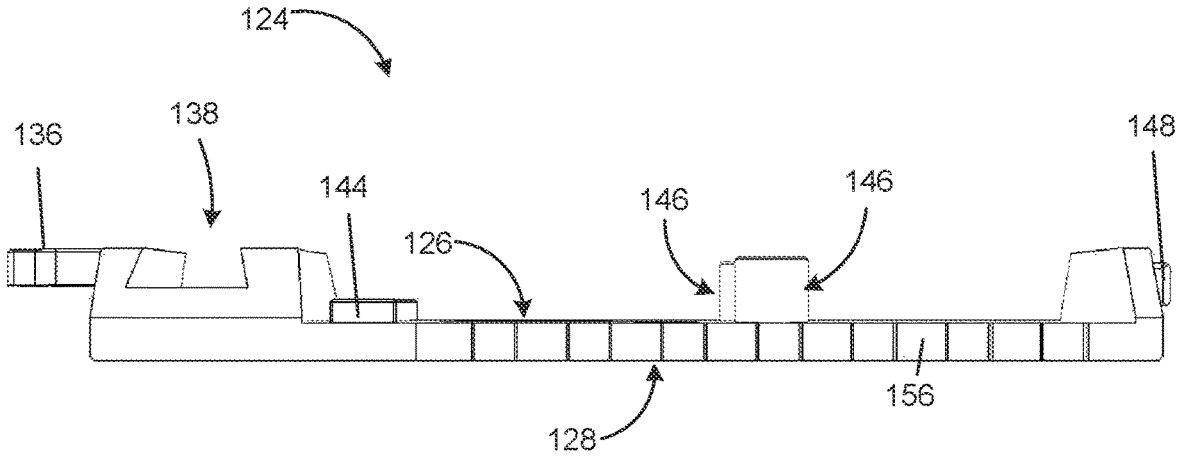
FIG. 3C is a side view of the mounting plate according to one or more examples of the disclosure.
Figure 3D:
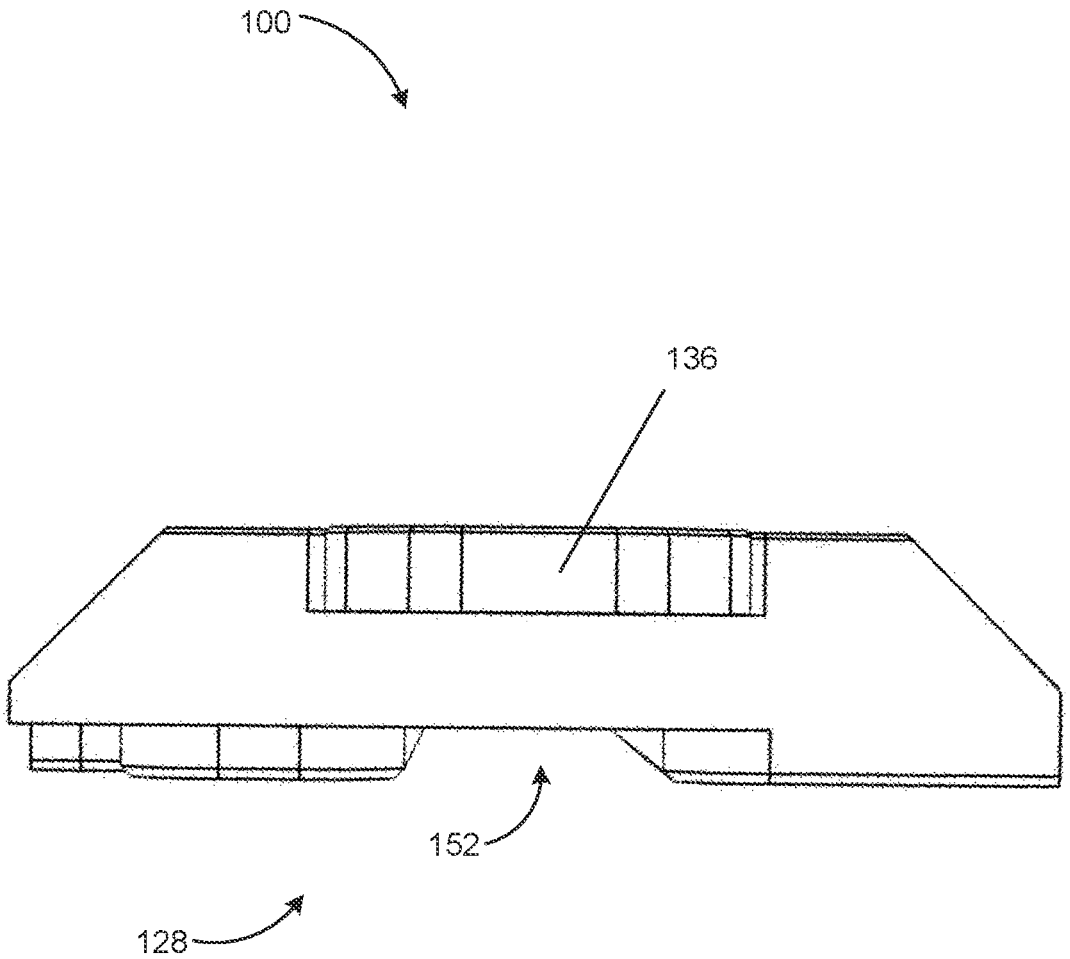
FIG. 3D is a front view of the mounting plate according to one or more examples of the disclosure.
Figure 3E:
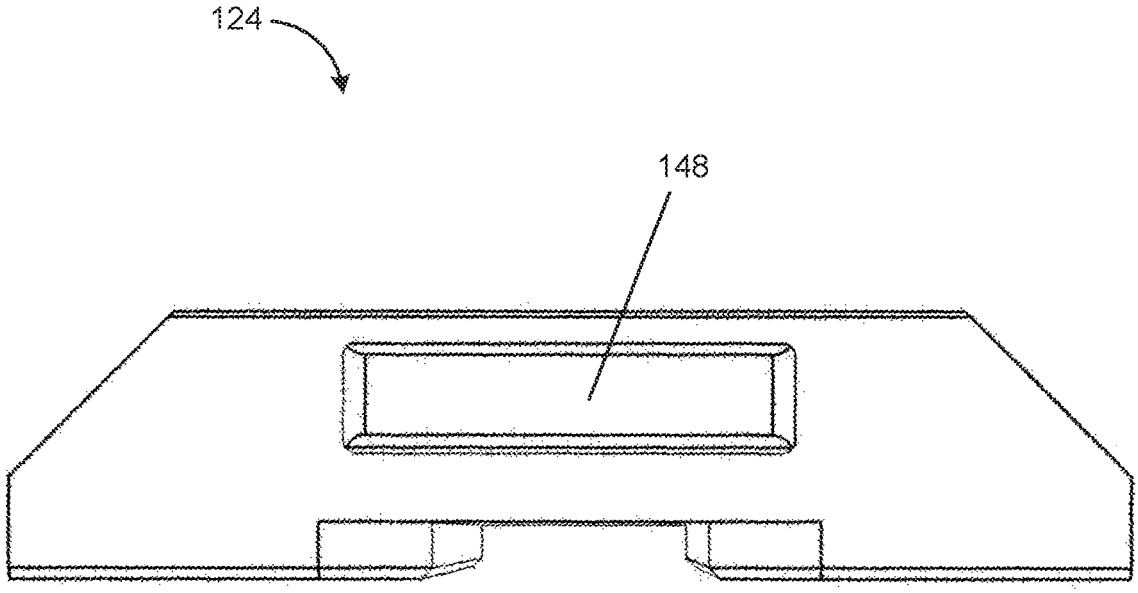
FIG. 3E is a rear view of the mounting plate according to one or more examples of the disclosure.

FIG. 3A is a perspective view of the mounting plate 124 according to one example. The mounting plate 124 includes an anchor 136 disposed on the front side 130 and a stud 148 disposed on the rear side 132. As the mounting plate 124 is lowered into the recess 110, the stud 148 can enter the slot 116 disposed within the recess 110 thereby securing the rear side 132 of the plate. In some examples, the anchor 136 is configured to engage the catch 118 disposed on the firearm slide 102. Once engaged, the anchor 136 includes an aperture 154 through which a fastener secures the anchor 136 into the firearm slide 102 by engaging the socket 122 (e.g., as shown in FIG. 1). The anchor 136 and the stud 148 can thereby secure the mounting plate 124 within the recess 110 with or without an optic or iron sight thereby attached to the mounting plate 124.

The mounting plate 124 can include an optic base surface 142 with engagement components such as a sight joint 138, one or more tabs 144, and boss 146 disposed thereon. In one example, the sight joint 138 is disposed adjacent to the front side 130 and a first plate wall 140A. The sight joint 138 can be shaped like a dovetail sight joint and thereby secure a complementing iron sight. Along the optic base surface 142, between the first plate wall 140A and an opposing second plate wall 140B, the one or more tabs 144 may be disposed to engage a bottom surface of an optic (not shown). The tabs 144 can be shaped as semi-circular protrusions extending away from the optic base surface 142. In other examples, the tabs 144 can be circular, rectangular, triangular, or some other shape. The tabs described herein may be placed anywhere along the mounting plate. Similarly, the optic base surface 142 can have one or more bosses 146 between the first plate wall 140A and the second plate wall 140B. The one or more bosses described herein may be placed anywhere along the optic base surface and align with sockets disposed on the firearm slide. The boss 146 can be hollow and include an aperture 154 to thereby receive a fastener. That is, the boss 146 can extend from the top surface 126 to the bottom surface 128 of the mounting plate 124. In some examples, the fastener may extend through the optic (not shown), through the boss 146, and into the firearm slide socket 122 once the mounting plate 124 is set onto the firearm slide 102. In other examples, the boss 146 may not have an aperture.

In some examples, the mounting plate 124 is substantially rectangular. For example, the mounting plate 124 can include a rectangular perimeter 134, a first plate wall 140A, and a second plate wall 140B. The plate walls 140A/140B can be at a 90-degree angle to an optic base surface 142. One or both of the plate walls 140A/140B can be straight or curved. In one example, the second plate wall 140B is a rectangular planar shape and the first plate wall 140A is a curved rectangular shape. In other examples, the plate walls 140A/140B may be triangular, circular, pyramidal, trapezoidal, or some other shape or combination of shapes. In other examples, the mounting plate 124 may be a different shape. For example, the plate walls 140A/140B may have an angle to the optic base surface 142 ranging from 1 degree to 179 degrees. The plate walls 140A/140B may be at the same or different angles from the optic base surface 142.

Figure 3F:
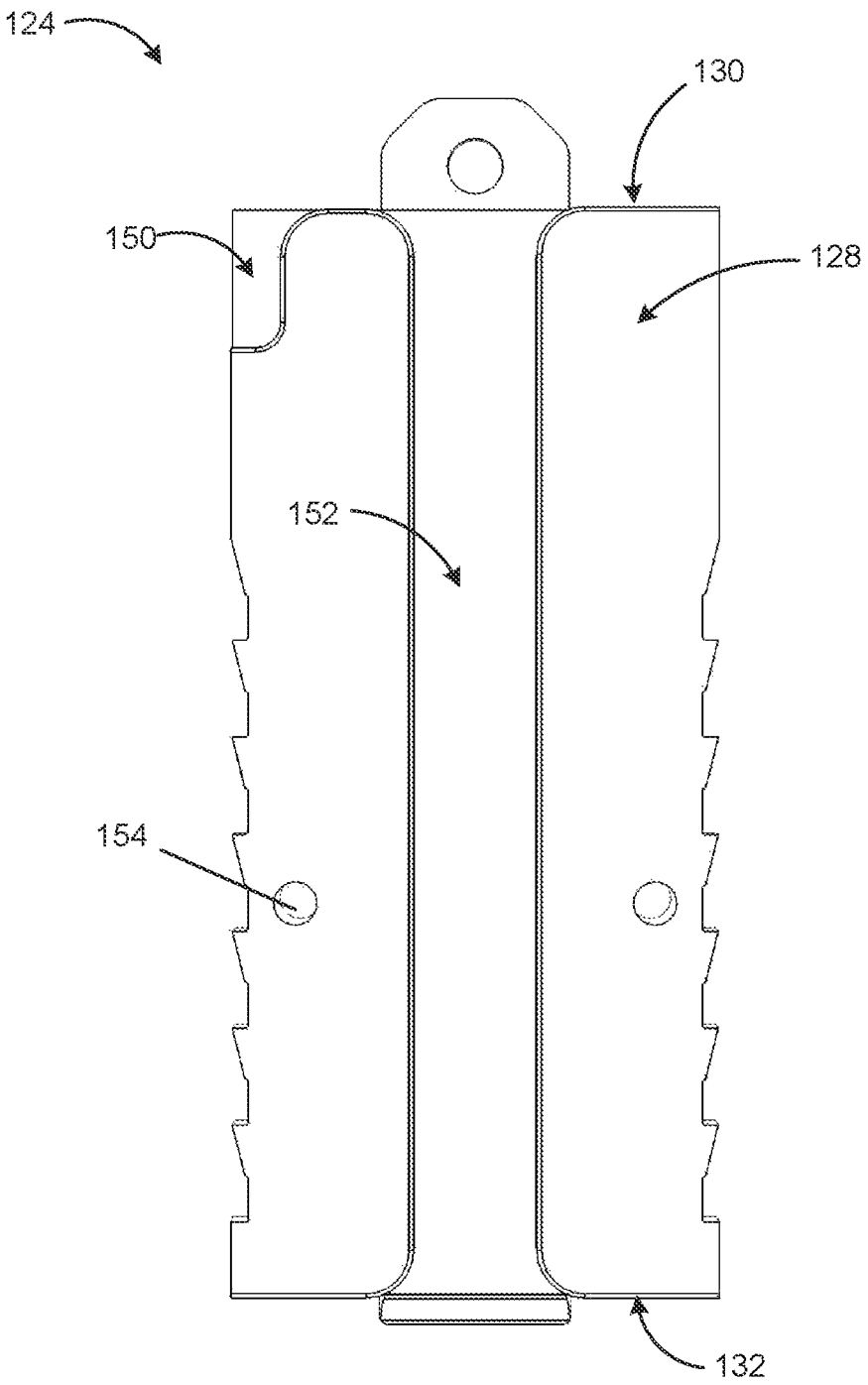
FIG. 3F is a bottom view of the mounting plate according to one or more examples of the disclosure.

Referring to FIG. 3F, the mounting plate 124 can include an ejector notch 150 and a channel 152 on the bottom surface 128 configured to engage the firearm slide recess 110. In one example, the ejector notch 150 complements the shape of the ejector projection 120 disposed within the recess 110. Similarly, the channel 152 can complement the shape of the rib 114 disposed within the recess 110. Both the ejector notch 150 and the channel 152 can slideably engage the ejector projection 120 and the rib 114, respectively. In some examples, the ejector notch 150 can be disposed adjacent to the front side 130. The channel 152 can extend from the front side 130 to the rear side 132. In other examples, the ejector notch 150 and the channel 152 can be disposed or extend along any portion of the mounting plate 124.

In some examples, as depicted in 1 and 3A-3C, the mounting plate 100 includes a series of indented ridges 156. In some examples, the series of indented ridges 156 extend along a perimeter 134 of the mounting plate 124 from the top surface 126 to the bottom surface 128. In other instances, the series of indented ridges 156 may extend in a different direction or at a different location on the mounting plate 124, such as on the front side 130. The indented ridges 156 may be any suitable size, shape, or configuration.

In some examples, the apertures 154 are flush with the top surface 126 of the mounting plate 124 or may protrude in other suitable directions. For example, the plurality of apertures 154 may protrude from the bottom surface 128 of the mounting plate. The plurality of apertures 154 may protrude or be flush with any other surface of the mounting plate 124. Each of the apertures 154 can include a threaded interior. The threaded interior accepts a fastener configured to secure the mounting plate 124 to the firearm slide 102. In some examples, the apertures 154 are sized to accept an eight gauge, 40 thread per inch screw. The screw may include Loctite® screw glue on the surface to secure the mounting plate 124. In other instances, the plurality of apertures 154 may accept different sized screws or other fasteners. For example, the plurality of apertures 154 may accept screw sizes from a 0 gauge to a 24 gauge screw. The screws and the complementary threading within the plurality of apertures may have a thread count of 1-100 threads per inch of the surface. The apertures may be disposed on any of the examples described herein. The apertures may be disposed on the optic plate surface and/or the anchor.

Figure 4A:
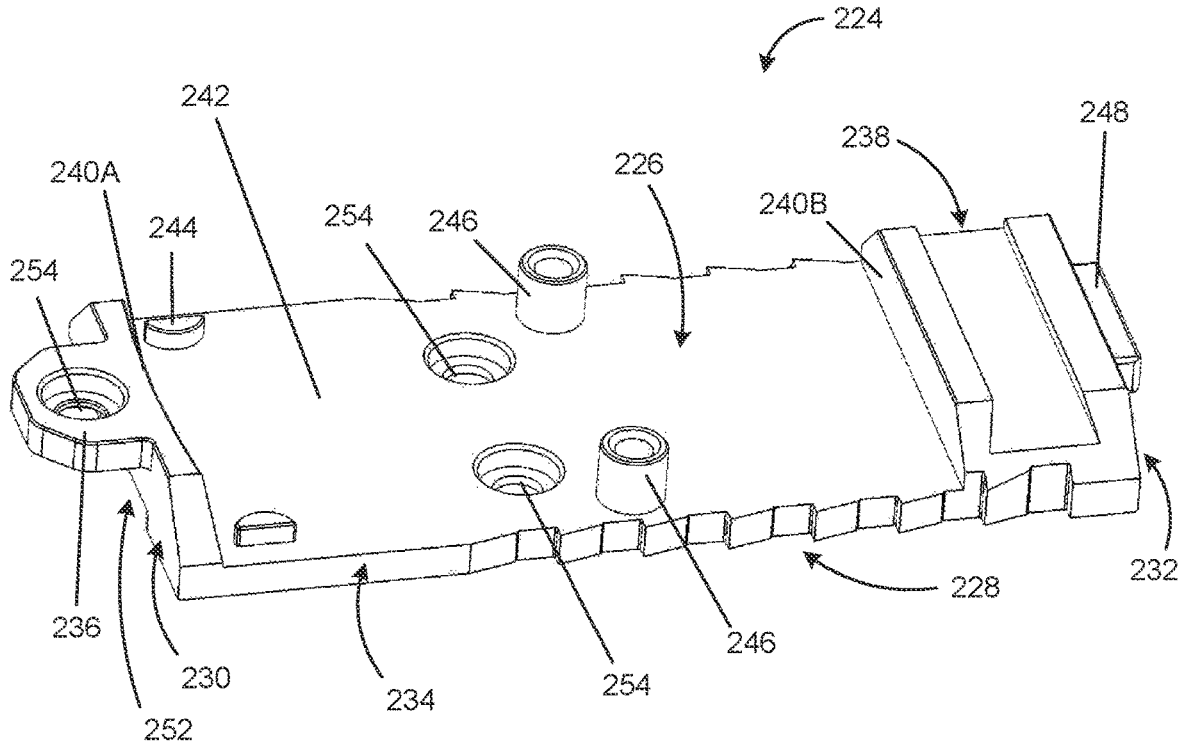
FIG. 4A is a perspective view of a mounting plate according to one or more examples of the disclosure.
Figure 4B:
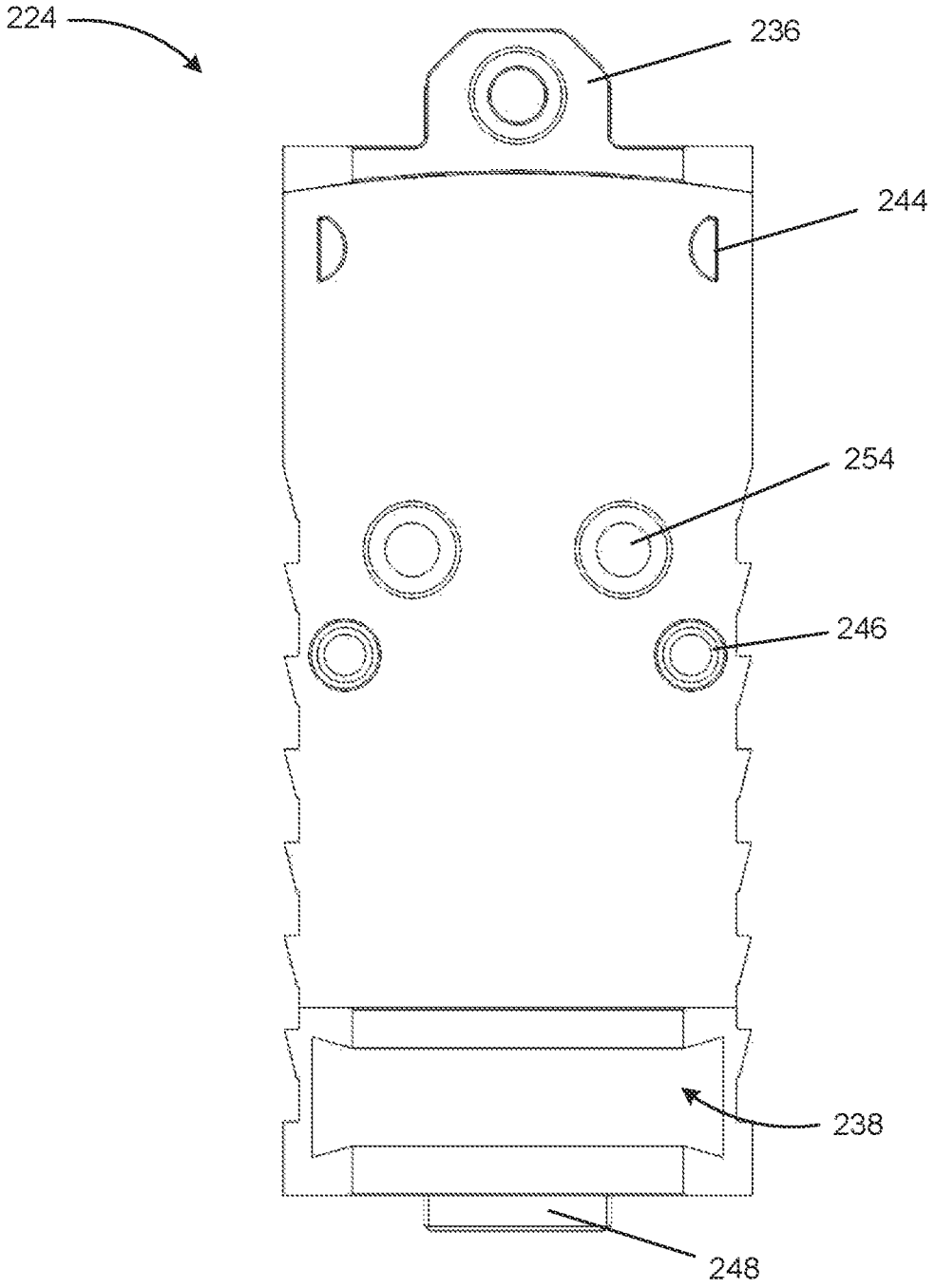
FIG. 4B is a top view of the mounting plate according to one or more examples of the disclosure.
Figure 4C:
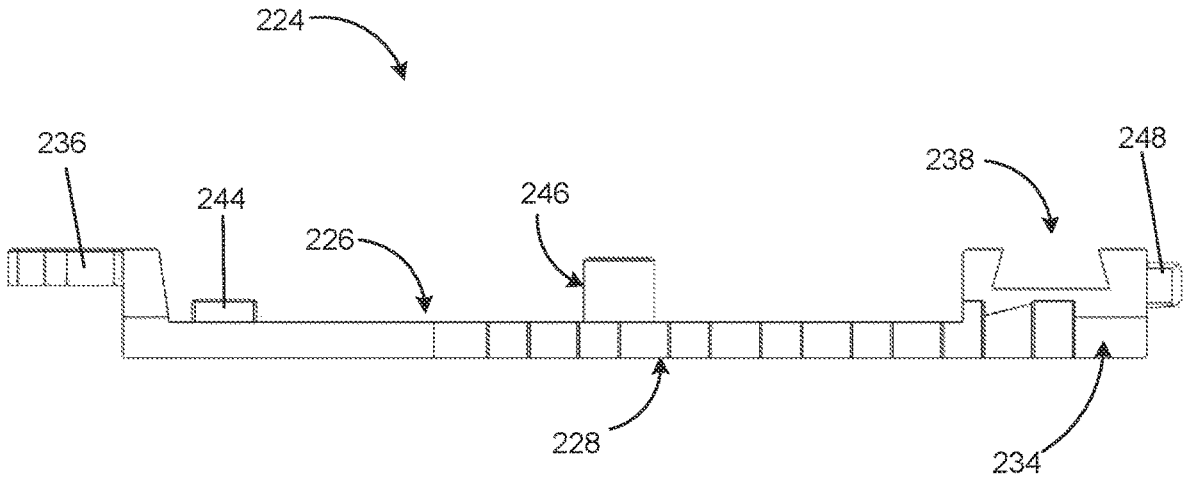
FIG. 4C is a side view of the mounting plate according to one or more examples of the disclosure.

FIG. 4A is a perspective view of a mounting plate according to one or more examples of the disclosure. FIG. 4B is a top view of the mounting plate according to one or more examples of the disclosure. FIG. 4C is a side view of the mounting plate according to one or more examples of the disclosure. Referring to FIG. 4A, the mounting plate 224 includes a top surface 226, an opposed bottom surface 228, a front side 230, and a rear side 232. Each surface may be configured for several purposes, including temporarily or permanently attaching the mounting plate 224 to a firearm or optic. As described below, the mounting plate 224 is configured to mount to a firearm slide 102. For example, the bottom surface 228 may be disposed within the recess 110 of the slide 102 and abut the base surface 115 of the recess 110 (e.g., as shown in FIG. 1). The mounting plate 224 enables a user to quickly change red dot sights and/or iron sights, and/or the configuration of the two (e.g., which is in front of the other), on a firearm slide 102.

The mounting plate 224 includes an anchor 236 disposed on the front side 230 and a stud 248 disposed on the rear side 232. As the mounting plate 224 is lowered into the recess 110, the stud 248 can enter the slot 116 disposed within the recess 110 thereby securing the rear side 232 of the plate. In some examples, the anchor 236 is configured to engage the catch 118 disposed on the firearm slide 102. Once engaged, the anchor 236 includes an aperture 254 through which a fastener secures the anchor 236 into the firearm slide 102 by engaging the socket 122 (e.g., as shown in FIG. 1). The anchor 236 and the stud 248 can thereby secure the mounting plate 224 within the recess 110 with or without an optic or iron sight thereby attached to the mounting plate 224.

The mounting plate 224 can include an optic base surface 242 with engagement components such as a sight joint 238, one or more tabs 244, and hollow bosses 246 disposed thereon. In one example, the sight joint 238 is disposed adjacent to the rear side 232 and a second plate wall 240B. The sight joint 238 can be shaped like a dovetail sight joint and thereby secure a complementing iron sight. Along the optic base surface 242, between the first plate wall 240A and an opposing second plate wall 240B, the one or more tabs 244 may be disposed to engage a bottom surface of an optic (not shown). The tabs 244 can be shaped as semi-circular protrusions extending away from the optic base surface 242. In other examples, the tabs 244 can be circular, rectangular, triangular, or some other shape. Similarly, the optic base surface 242 can have one or more bosses 246 between the first plate wall 240A and the second plate wall 240B. The boss 246 can be hollow and include an aperture 254 to thereby receive a fastener. That is, the boss 246 can extend from the top surface 226 to the bottom surface 228 of the mounting plate 224. In some examples, the fastener may extend through the optic (not shown), through the boss 246, and into the firearm slide socket 122 once the mounting plate 224 is set onto the firearm slide 102. In other examples, the boss 246 may not have an aperture. A channel 252 can be disposed along the bottom surface 228 configured to engage the recess 110.

The mounting plate 224 can include one or more apertures 254 disposed on the optical base surface 242. In one example, the apertures 254 can be disposed on the optical base surface 242 to receive a fastener that secures the mounting plate 224 to the firearm slide 102 before an optic is set into place on the optical base surface 242. The anchor 236 can include one or more apertures 254 that can receive a fastener that secures the mounting plate 224 to the firearm slide 102 with or without an optic set into place. In other examples, the apertures 254 can be disposed anywhere along the mounting plate 224.

In some examples, the mounting plate 224 is substantially rectangular. For example, the mounting plate 224 can include a rectangular perimeter 234, a first plate wall 240A, and a second plate wall 240B. The plate walls 240A/240B can be at a 90-degree angle to an optic base surface 242. One or both of the plate walls 240A/240B can be straight or curved. In one example, the second plate wall 240B is a rectangular planar shape and the first plate wall 240A is curved rectangular shape. In other examples, the plate walls 240A/240B may be triangular, circular, pyramidal, trapezoidal, or some other shape or combination of shapes. In other examples, the mounting plate 224 may be a different shape. For example, the plate walls 240A/240B may have an angle to the optic base surface 242 ranging from 1 degree to 179 degrees. The plate walls 240A/240B may be at the same or different angles from the optic base surface 242.

Figure 5A:
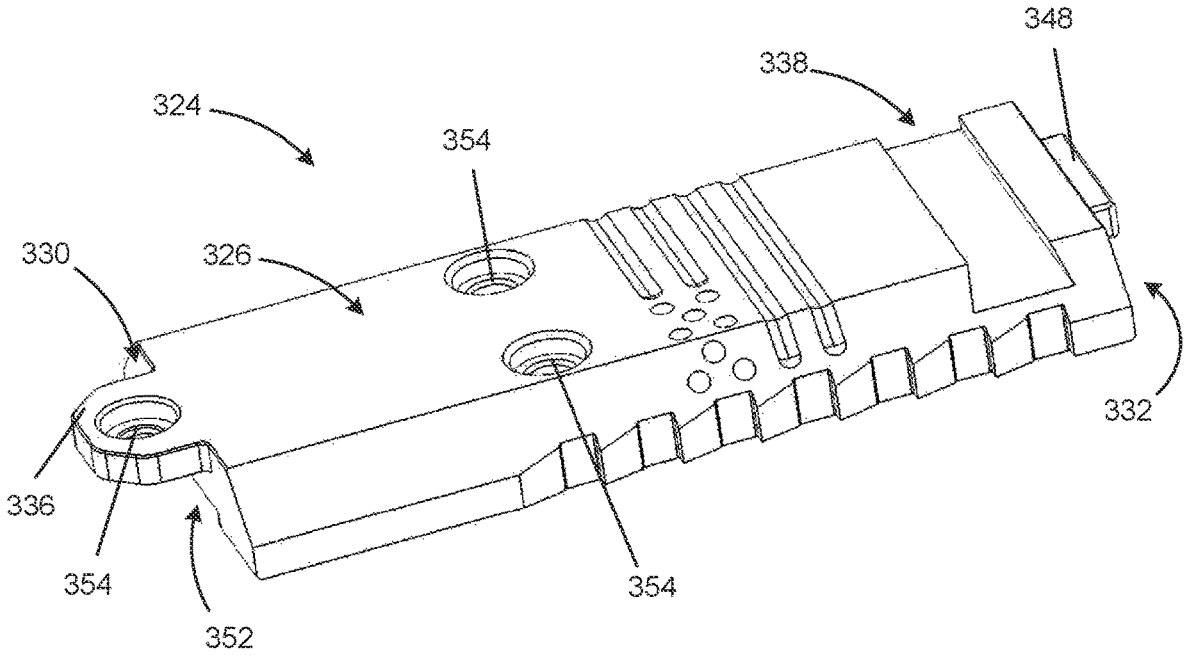
FIG. 5A is a perspective view of a mounting plate according to one or more examples of the disclosure.
Figure 5B:
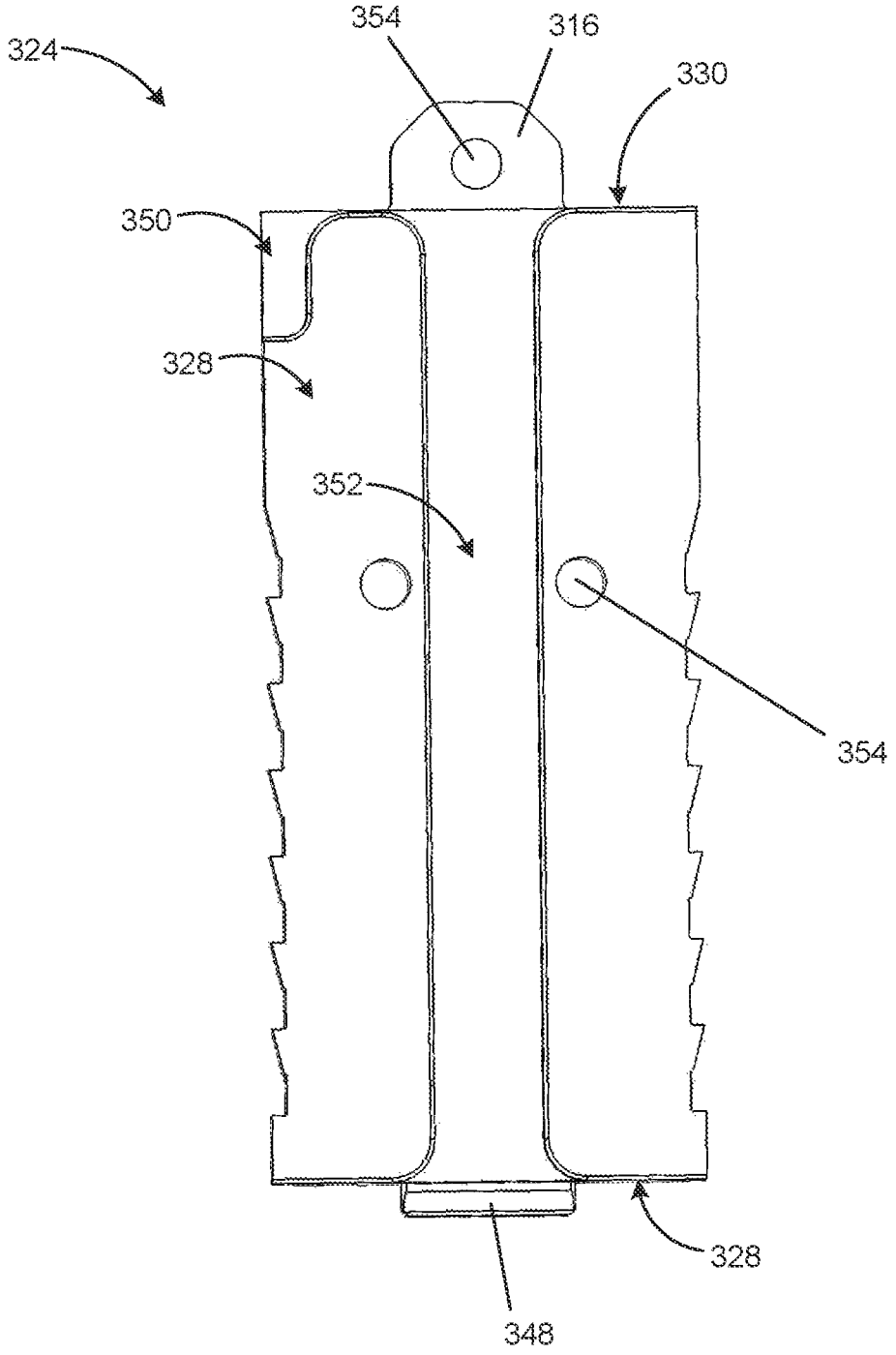
FIG. 5B is a bottom view of the mounting plate according to one or more examples of the disclosure.

FIG. 5A is a perspective view of a mounting plate according to one or more examples of the disclosure. FIG. 5B is a bottom view of the mounting plate according to one or more examples of the disclosure. Referring to FIG. 5A, the mounting plate 324 includes a top surface 326, an opposed bottom surface 328, a front side 330, and a rear side 332. Each surface may be configured for several purposes, including temporarily or permanently attaching the mounting plate 324 to a firearm or optic. As described below, the mounting plate 324 is configured to mount to a firearm slide 102. For example, the bottom surface 328 may be disposed within the recess 110 of the slide 102 and abut the base surface 115 of the recess 110 (e.g., as shown in FIG. 1).

The mounting plate 324 includes an anchor 336 disposed on the front side 330 and a stud 348 disposed on the rear side 332. As the mounting plate 324 is lowered into the recess 110, the stud 348 can enter the slot 316 disposed within the recess 110 thereby securing the rear side 332 of the plate. In some examples, the anchor 336 is configured to engage the catch 118 disposed on the firearm slide 102. Once engaged, the anchor 336 includes an aperture 354 through which a fastener secures the anchor 336 into the firearm slide 102 by engaging the socket 122 (e.g., as shown in FIG. 1). The anchor 336 and the stud 348 can thereby secure the mounting plate 324 within the recess 110.

The mounting plate 324 can include a sight joint 338. In one example, the sight joint 338 is disposed adjacent to the rear side 332. The sight joint 338 can be shaped like a dovetail sight joint and thereby secure a complementing iron sight. In one example, the apertures 354 can be disposed on the top surface 326 to receive a fastener that secures the mounting plate 324 to the firearm slide 102. The anchor 336 can include one or more apertures 354 that can receive a fastener that secures the mounting plate 324 to the firearm slide 102 with or without an optic set into place. In other examples, the apertures 354 can be disposed anywhere along the mounting plate 324.

Referring to FIG. 5B, the mounting plate 324 can include an ejector notch 350 and a channel 352 on the bottom surface 328 configured to engage the firearm slide recess 110. In one example, the ejector notch 350 complements the shape of the ejector projection 120 disposed within the recess 110. Similarly, the channel 352 can complement the shape of the rib 114 disposed within the recess 110. Both the ejector notch 350 and the channel 352 can slideably engage the ejector projection 120 and the rib 114, respectively. In some examples, the ejector notch 350 can be disposed adjacent to the front side 330. The channel 352 can extend from the front side 330 to the rear side 332. In other examples, the ejector notch 350 and the channel 352 can be disposed or extend along any portion of the mounting plate 324.

Figure 6:
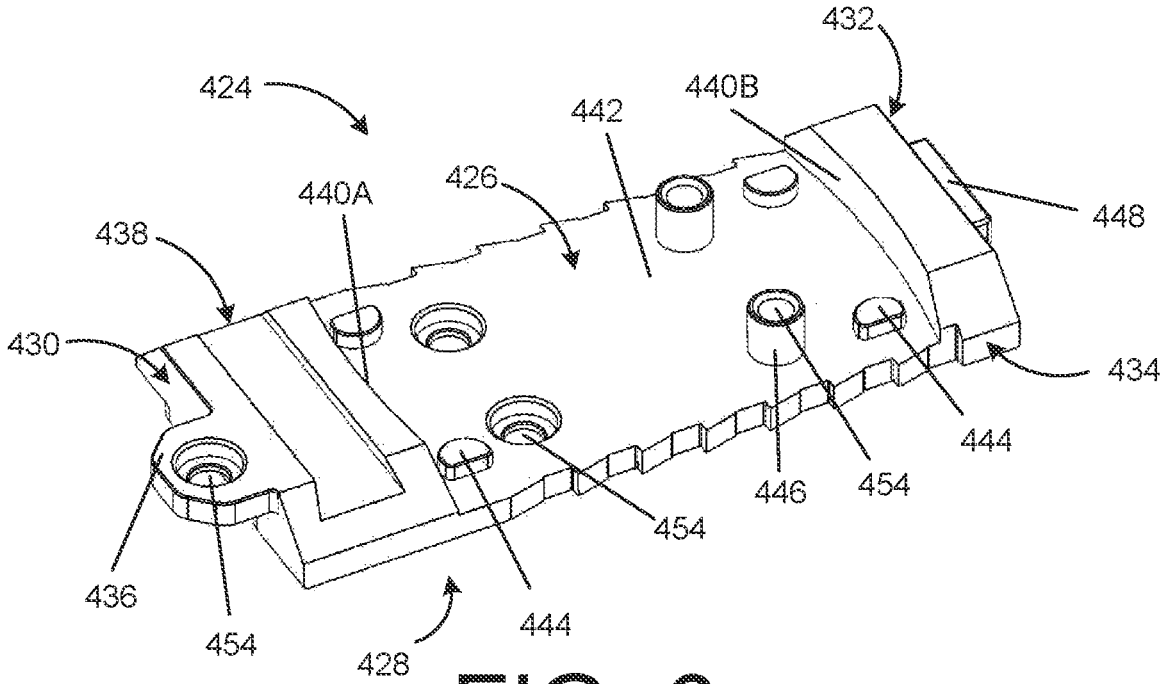
FIG. 6 is a perspective view of a mounting plate according to one or more examples of the disclosure.

FIG. 6 depicts a mounting plate 424 configured to secure into the firearm slide recess 110. In one example, the mounting plate 424 includes a top surface 426, an opposed bottom surface 428, a front side 430, and a rear side 432. Each surface may be configured for several purposes, including temporarily or permanently attaching the mounting plate 424 to a firearm or optic. As described below, the mounting plate 424 is configured to mount to a firearm slide 102. For example, the bottom surface 428 may be disposed within the recess 110 of the slide 102 and abut the base surface 115 of the recess 110. The mounting plate 424 enables a user to quickly change red dot sights and/or iron sights, and/or the configuration of the two (e.g., which is in front of the other), on a firearm slide 102.

FIG. 6 is a perspective view of the mounting plate 424 according to one example. The mounting plate 424 includes an anchor 436 disposed on the front side 430 and a stud 448 disposed on the rear side 432. As the mounting plate 424 is lowered into the recess 110, the stud 148 can enter the slot 116 disposed within the recess 110 thereby securing the rear side 432 of the plate. In some examples, the anchor 436 is configured to engage the catch 118 disposed on the firearm slide 102. Once engaged, the anchor 436 includes an aperture 454 through which a fastener secures the anchor 436 into the firearm slide 102 by engaging the socket 122 (e.g., as shown in FIG. 1). The anchor 436 and the stud 448 can thereby secure the mounting plate 424 within the recess 110 with or without an optic or iron sight thereby attached to the mounting plate 424.

The mounting plate 424 can include an optic base surface 442 with engagement components such as a sight joint 438, one or more tabs 444, and hollow bosses 446 disposed thereon. In one example, the sight joint 438 is disposed adjacent to the front side 430 and a first plate wall 440A. The sight joint 438 can be shaped like a dovetail sight joint and thereby secure a complementing iron sight. Along the optic base surface 442, between the first plate wall 440A and an opposing second plate wall 440B, the one or more tabs 444 may be disposed to engage a bottom surface of an optic (not shown). The tabs 444 can be shaped as semi-circular protrusions extending away from the optic base surface 442. In other examples, the tabs 444 can be circular, rectangular, triangular, or some other shape. Similarly, the optic base surface 442 can have one or more bosses 446 between the first plate wall 440A and the second plate wall 440B. The boss 446 can be hollow and include an aperture 454 to thereby receive a fastener. That is, the boss 446 can extend from the top surface 426 to the bottom surface 428 of the mounting plate 424. In some examples, the fastener may extend through the optic (not shown), through the boss 446, and into the firearm slide socket 122 once the mounting plate 424 is set onto the firearm slide 102. In other examples, the boss 446 may not have an aperture.

The mounting plate 424 can include one or more apertures 454 disposed on the optical base surface 442. In one example, the apertures 454 can be disposed on the optical base surface 442 to receive a fastener that secures the mounting plate 424 to the firearm slide 102 before an optic is set into place on the optical base surface 442. The anchor 436 can include one or more apertures 454 that can receive a fastener that secures the mounting plate 424 to the firearm slide 102 with or without an optic set into place. In other examples, the apertures 454 can be disposed anywhere along the mounting plate 424.

In some examples, the mounting plate 424 is substantially rectangular. For example, the mounting plate 424 can include a rectangular perimeter 434, a first plate wall 440A, and a second plate wall 440B. The plate walls 440A/440B can be at a 90-degree angle to an optic base surface 442. One or both of the plate walls 440A/440B can be straight or curved. In one example, the second plate wall 440B is a rectangular planar shape and the first plate wall 440A is a curved rectangular shape. In other examples, the plate walls 440A/440B may be triangular, circular, pyramidal, trapezoidal, or some other shape or combination of shapes. In other examples, the mounting plate 424 may be a different shape. For example, the plate walls 440A/440B may have an angle to the optic base surface 442 ranging from 1 degree to 179 degrees. The plate walls 440A/440B may be at the same or different angles from the optic base surface 442.

Figure 7:
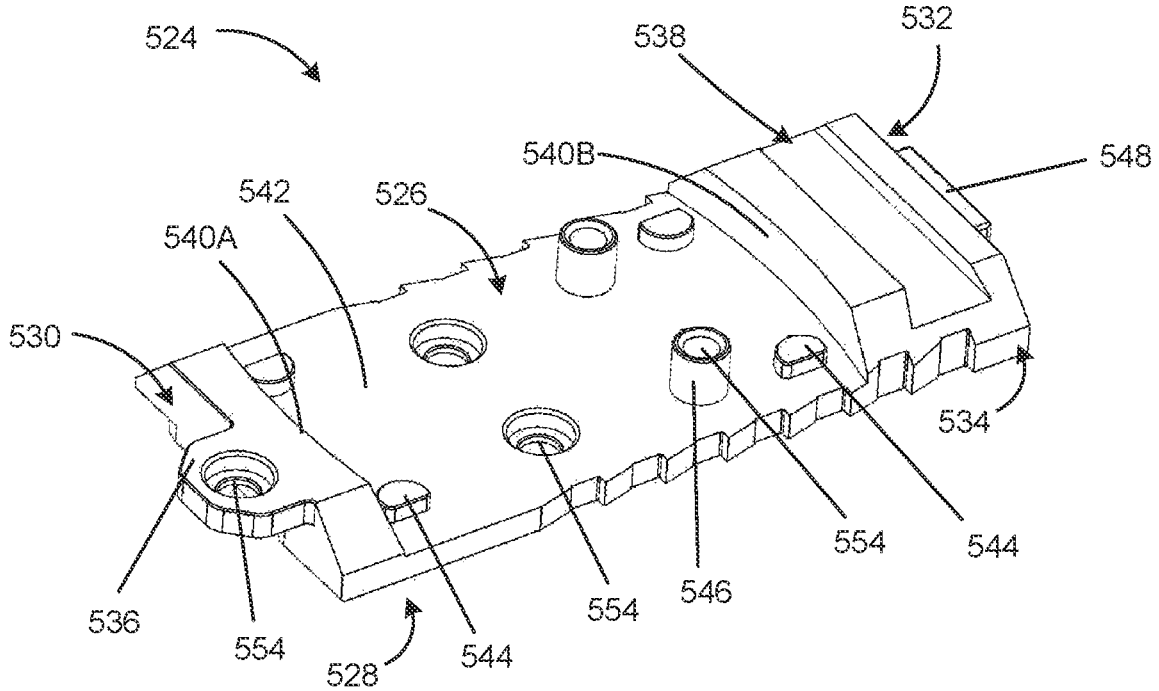
FIG. 7 is a perspective view of a mounting plate according to one or more examples of the disclosure.

FIG. 7 depicts a mounting plate 524 configured to secure into the firearm slide recess 110. In one example, the mounting plate 524 includes a top surface 526, an opposed bottom surface 528, a front side 530, and a rear side 532. Each surface may be configured for several purposes, including temporarily or permanently attaching the mounting plate 524 to a firearm or optic. As described below, the mounting plate 524 is configured to mount to a firearm slide 102. For example, the bottom surface 528 may be disposed within the recess 110 of the slide 102 and abut the base surface 115 of the recess 110. The mounting plate 524 enables a user to quickly change red dot sights and/or iron sights, and/or the configuration of the two (e.g., which is in front of the other), on a firearm slide 102.

FIG. 7 is a perspective view of the mounting plate 524 according to one example. The mounting plate 524 includes an anchor 536 disposed on the front side 530 and a stud 548 disposed on the rear side 532. As the mounting plate 524 is lowered into the recess 110, the stud 548 can enter the slot 116 disposed within the recess 110 thereby securing the rear side 532 of the plate. In some examples, the anchor 536 is configured to engage the catch 118 disposed on the firearm slide 102. Once engaged, the anchor 536 includes an aperture 554 through which a fastener secures the anchor 536 into the firearm slide 102 by engaging the socket 122 (e.g., as shown in FIG. 1). The anchor 536 and the stud 548 can thereby secure the mounting plate 524 within the recess 110 with or without an optic or iron sight thereby attached to the mounting plate 524.

The mounting plate 524 can include an optic base surface 542 with engagement components such as a sight joint 538, one or more tabs 544, and hollow bosses 546 disposed thereon. In one example, the sight joint 538 is disposed adjacent to the rear side 532 and a second plate wall 540B. The sight joint 538 can be shaped like a dovetail sight joint and thereby secure a complementing iron sight. Along the optic base surface 542, between the first plate wall 540A and an opposing second plate wall 540B, the one or more tabs 544 may be disposed to engage a bottom surface of an optic (not shown). The tabs 544 can be shaped as semi-circular protrusions extending away from the optic base surface 542. In other examples, the tabs 544 can be circular, rectangular, triangular, or some other shape. Similarly, the optic base surface 542 can have one or more bosses 546 between the first plate wall 540A and the second plate wall 540B. The boss 546 can be hollow and include an aperture 554 to thereby receive a fastener. That is, the boss 546 can extend from the top surface 526 to the bottom surface 528 of the mounting plate 524. In some examples, the fastener may extend through the optic (not shown), through the boss 546, and into the firearm slide socket 122 once the mounting plate 524 is set onto the firearm slide 102. In other examples, the boss 546 may not have an aperture.

The mounting plate 524 can include one or more apertures 554 disposed on the optical base surface 542. In one example, the apertures 554 can be disposed on the optical base surface 542 to receive a fastener that secures the mounting plate 524 to the firearm slide 102 before an optic is set into place on the optical base surface 542. The anchor 536 can include one or more apertures 554 that can receive a fastener that secures the mounting plate 524 to the firearm slide 102 with or without an optic set into place. In other examples, the apertures 554 can be disposed anywhere along the mounting plate 524.

In some examples, the mounting plate 524 is substantially rectangular. For example, the mounting plate 524 can include a rectangular perimeter 534, a first plate wall 540A, and a second plate wall 540B. The plate walls 540A/540B can be at a 90-degree angle to an optic base surface 542. One or both of the plate walls 540A/540B can be straight or curved. In one example, the second plate wall 540B is a rectangular planar shape and the first plate wall 540A is curved rectangular shape. In other examples, the plate walls 540A/540B may be triangular, circular, pyramidal, trapezoidal, or some other shape or combination of shapes. In other examples, the mounting plate 524 may be a different shape. For example, the plate walls 540A/540B may have an angle to the optic base surface 542 ranging from 1 degree to 179 degrees. The plate walls 540A/540B may be at the same or different angles from the optic base surface 542.

Figure 8:
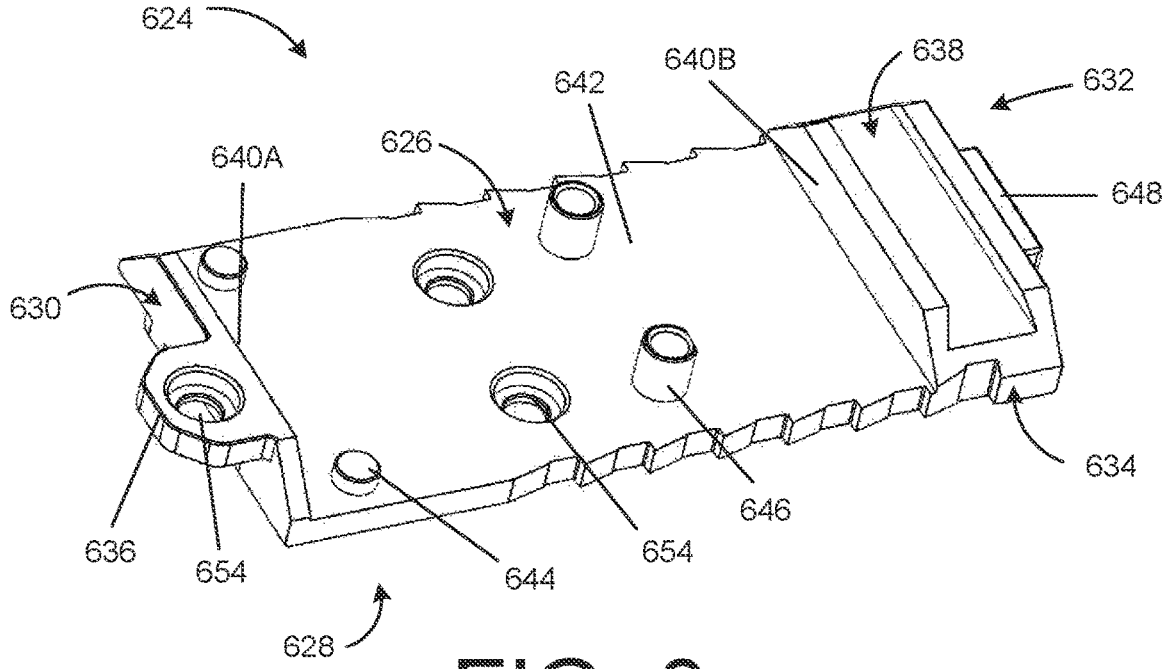
FIG. 8 is a perspective view of a mounting plate according to one or more examples of the disclosure.

FIG. 8 depicts a mounting plate 624 configured to secure into the firearm slide recess 110. In one example, the mounting plate 624 includes a top surface 626, an opposed bottom surface 628, a front side 630, and a rear side 632. Each surface may be configured for several purposes, including temporarily or permanently attaching the mounting plate 624 to a firearm or optic. As described below, the mounting plate 624 is configured to mount to a firearm slide 102. For example, the bottom surface 628 may be disposed within the recess 110 of the slide 102 and abut the base surface 115 of the recess 110. The mounting plate 624 enables a user to quickly change red dot sights and/or iron sights, and/or the configuration of the two (e.g., which is in front of the other), on a firearm slide 102.

FIG. 8 is a perspective view of the mounting plate 624 according to one example. The mounting plate 624 includes an anchor 636 disposed on the front side 630 and a stud 648 disposed on the rear side 632. As the mounting plate 624 is lowered into the recess 110, the stud 648 can enter the slot 116 disposed within the recess 110 thereby securing the rear side 632 of the plate. In some examples, the anchor 636 is configured to engage the catch 118 disposed on the firearm slide 102. Once engaged, the anchor 636 includes an aperture 654 through which a fastener secures the anchor 636 into the firearm slide 102 by engaging the socket 122 (e.g., as shown in FIG. 1). The anchor 636 and the stud 648 can thereby secure the mounting plate 624 within the recess 110 with or without an optic or iron sight thereby attached to the mounting plate 624.

The mounting plate 624 can include an optic base surface 642 with engagement components such as a sight joint 638, one or more tabs 644, and hollow bosses 646 disposed thereon. In one example, the sight joint 638 is disposed adjacent to the rear side 632 and a second plate wall 640B. The sight joint 638 can be shaped like a dovetail sight joint and thereby secure a complementing iron sight. Along the optic base surface 642, between the first plate wall 640A and an opposing second plate wall 640B, the one or more tabs 644 may be disposed to engage a bottom surface of an optic (not shown). The tabs 644 can be shaped as semi-circular protrusions extending away from the optic base surface 642. In other examples, the tabs 644 can be circular, rectangular, triangular, or some other shape. Similarly, the optic base surface 642 can have one or more bosses 646 between the first plate wall 640A and the second plate wall 640B. The boss 646 can be hollow and include an aperture 654 to thereby receive a fastener. That is, the boss 646 can extend from the top surface 626 to the bottom surface 628 of the mounting plate 624. In some examples, the fastener may extend through the optic (not shown), through the boss 646, and into the firearm slide socket 122 once the mounting plate 624 is set onto the firearm slide 102. In other examples, the boss 646 may not have an aperture.

The mounting plate 624 can include one or more apertures 654 disposed on the optical base surface 642. In one example, the apertures 654 can be disposed on the optical base surface 642 to receive a fastener that secures the mounting plate 624 to the firearm slide 102 before an optic is set into place on the optical base surface 642. The anchor 636 can include one or more apertures 654 that can receive a fastener that secures the mounting plate 624 to the firearm slide 102 with or without an optic set into place. In other examples, the apertures 654 can be disposed anywhere along the mounting plate 624.

In some examples, the mounting plate 624 is substantially rectangular. For example, the mounting plate 624 can include a rectangular perimeter 634, a first plate wall 640A, and a second plate wall 640B. The plate walls 640A/640B can be at a 90-degree angle to an optic base surface 642. One or both of the plate walls 640A/640B can be straight or curved. In one example, the second plate wall 640B is a rectangular planar shape and the first plate wall 640A is a curved rectangular shape. In other examples, the plate walls 640A/640B may be triangular, circular, pyramidal, trapezoidal, or some other shape or combination of shapes. In other examples, the mounting plate 624 may be a different shape. For example, the plate walls 640A/640B may have an angle to the optic base surface 642 ranging from 1 degree to 179 degrees. The plate walls 640A/640B may be at the same or different angles from the optic base surface 642.

Figure 9:
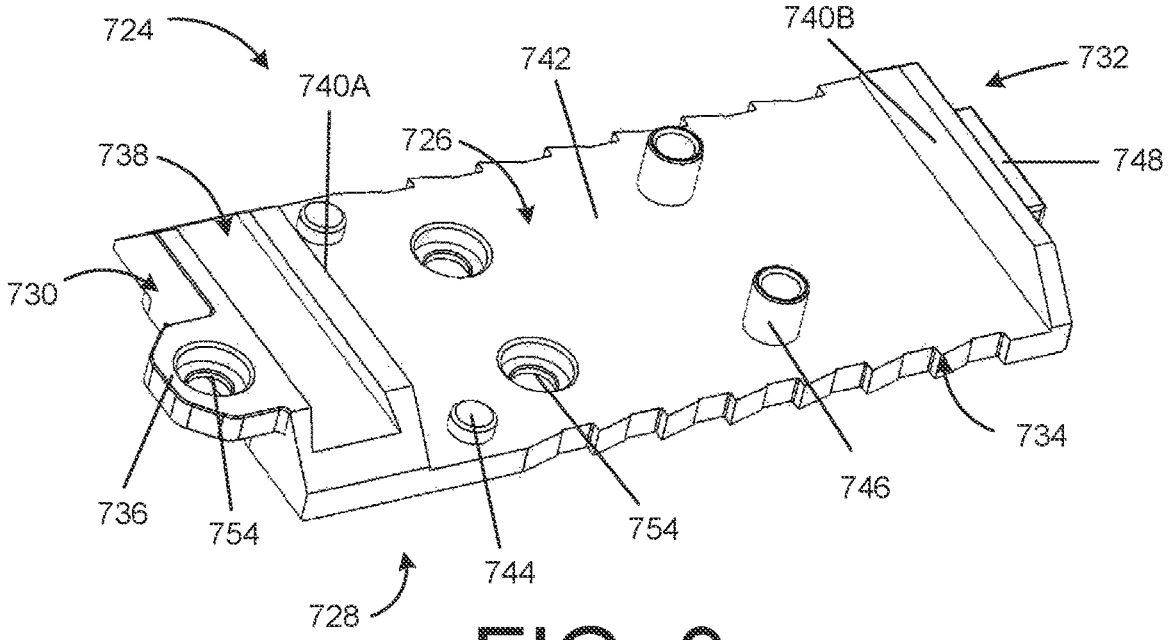
FIG. 9 is a perspective view of a mounting plate according to one or more examples of the disclosure.

FIG. 9 depicts a mounting plate 724 configured to secure into the firearm slide recess 110. In one example, the mounting plate 724 includes a top surface 726, an opposed bottom surface 728, a front side 730, and a rear side 732. Each surface may be configured for several purposes, including temporarily or permanently attaching the mounting plate 724 to a firearm or optic. As described below, the mounting plate 724 is configured to mount to a firearm slide 102. For example, the bottom surface 728 may be disposed within the recess 110 of the slide 102 and abut the base surface 115 of the recess 110. The mounting plate 724 enables a user to quickly change red dot sights and/or iron sights, and/or the configuration of the two (e.g., which is in front of the other), on a firearm slide 102.

FIG. 9 is a perspective view of the mounting plate 724 according to one example. The mounting plate 724 includes an anchor 736 disposed on the front side 730 and a stud 748 disposed on the rear side 732. As the mounting plate 724 is lowered into the recess 110, the stud 748 can enter the slot 116 disposed within the recess 110 thereby securing the rear side 732 of the plate. In some examples, the anchor 736 is configured to engage the catch 118 disposed on the firearm slide 102. Once engaged, the anchor 736 includes an aperture 754 through which a fastener secures the anchor 736 into the firearm slide 102 by engaging the socket 122 (e.g., as shown in FIG. 1). The anchor 736 and the stud 748 can thereby secure the mounting plate 724 within the recess 110 with or without an optic or iron sight thereby attached to the mounting plate 724.

The mounting plate 724 can include an optic base surface 742 with engagement components such as a sight joint 738, one or more tabs 744, and hollow bosses 746 disposed thereon. In one example, the sight joint 738 is disposed adjacent to the front side 730 and a first plate wall 740A. The sight joint 738 can be shaped like a dovetail sight joint and thereby secure a complementing iron sight. Along the optic base surface 742, between the first plate wall 740A and an opposing second plate wall 740B, the one or more tabs 744 may be disposed to engage a bottom surface of an optic (not shown). The tabs 744 can be shaped as semi-circular protrusions extending away from the optic base surface 742. In other examples, the tabs 744 can be circular, rectangular, triangular, or some other shape. Similarly, the optic base surface 742 can have one or more bosses 746 between the first plate wall 740A and the second plate wall 740B. The boss 746 can be hollow and include an aperture 754 to thereby receive a fastener. That is, the boss 746 can extend from the top surface 726 to the bottom surface 728 of the mounting plate 724. In some examples, the fastener may extend through the optic (not shown), through the boss 746, and into the firearm slide socket 122 once the mounting plate 724 is set onto the firearm slide 102. In other examples, the boss 746 may not have an aperture.

The mounting plate 724 can include one or more apertures 754 disposed on the optical base surface 742. In one example, the apertures 754 can be disposed on the optical base surface 742 to receive a fastener that secures the mounting plate 724 to the firearm slide 102 before an optic is set into place on the optical base surface 742. The anchor 736 can include one or more apertures 754 that can receive a fastener that secures the mounting plate 724 to the firearm slide 102 with or without an optic set into place. In other examples, the apertures 754 can be disposed anywhere along the mounting plate 724.

In some examples, the mounting plate 724 is substantially rectangular. For example, the mounting plate 724 can include a rectangular perimeter 734, a first plate wall 740A, and a second plate wall 740B. The plate walls 740A/740B can be at a 90-degree angle to an optic base surface 742. One or both of the plate walls 740A/740B can be straight or curved. In one example, the second plate wall 740B is a rectangular planar shape and the first plate wall 740A is curved rectangular shape. In other examples, the plate walls 740A/740B may be triangular, circular, pyramidal, trapezoidal, or some other shape or combination of shapes. In other examples, the mounting plate 724 may be a different shape. For example, the plate walls 740A/740B may have an angle to the optic base surface 742 ranging from 1 degree to 179 degrees. The plate walls 740A/740B may be at the same or different angles from the optic base surface 742.

Figure 10:
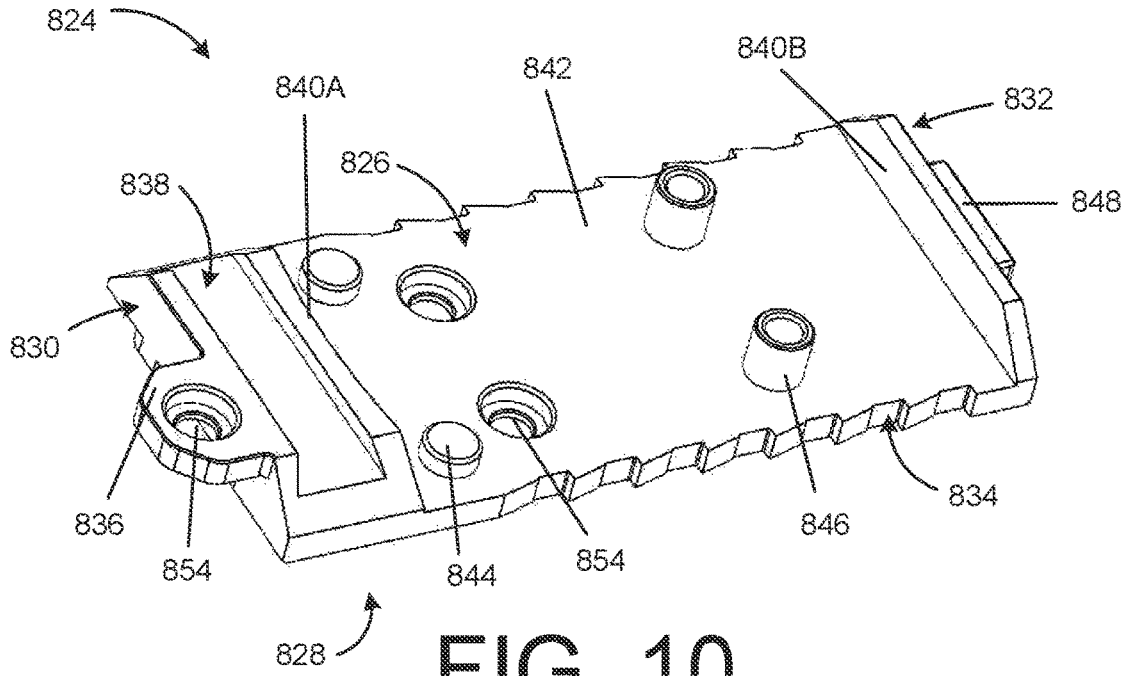
FIG. 10 is a perspective view of a mounting plate according to one or more examples of the disclosure.

FIG. 10 depicts a mounting plate 824 configured to secure into the firearm slide recess 110. In one example, the mounting plate 824 includes a top surface 826, an opposed bottom surface 828, a front side 830, and a rear side 832. Each surface may be configured for several purposes, including temporarily or permanently attaching the mounting plate 824 to a firearm or optic. As described below, the mounting plate 824 is configured to mount to a firearm slide 102. For example, the bottom surface 828 may be disposed within the recess 110 of the slide 102 and abut the base surface 115 of the recess 110. The mounting plate 824 enables a user to quickly change red dot sights and/or iron sights, and/or the configuration of the two (e.g., which is in front of the other), on a firearm slide 102.

FIG. 10 is a perspective view of the mounting plate 824 according to one example. The mounting plate 824 includes an anchor 836 disposed on the front side 830 and a stud 848 disposed on the rear side 832. As the mounting plate 824 is lowered into the recess 110, the stud 848 can enter the slot 116 disposed within the recess 110 thereby securing the rear side 832 of the plate. In some examples, the anchor 836 is configured to engage the catch 118 disposed on the firearm slide 102. Once engaged, the anchor 836 includes an aperture 854 through which a fastener secures the anchor 836 into the firearm slide 102 by engaging the socket 122 (e.g., as shown in FIG. 1). The anchor 836 and the stud 848 can thereby secure the mounting plate 824 within the recess 110 with or without an optic or iron sight thereby attached to the mounting plate 824.

The mounting plate 824 can include an optic base surface 842 with engagement components such as a sight joint 838, one or more tabs 844, and hollow bosses 846 disposed thereon. In one example, the sight joint 838 is disposed adjacent to the front side 830 and a first plate wall 840A. The sight joint 838 can be shaped like a dovetail sight joint and thereby secure a complementing iron sight. Along the optic base surface 842, between the first plate wall 840A and an opposing second plate wall 840B, the one or more tabs 844 may be disposed to engage a bottom surface of an optic (not shown). The tabs 844 can be shaped as semi-circular protrusions extending away from the optic base surface 842. In other examples, the tabs 844 can be circular, rectangular, triangular, or some other shape. Similarly, the optic base surface 842 can have one or more bosses 846 between the first plate wall 840A and the second plate wall 840B. The boss 846 can be hollow and include an aperture 854 to thereby receive a fastener. That is, the boss 846 can extend from the top surface 826 to the bottom surface 828 of the mounting plate 824. In some examples, the fastener may extend through the optic (not shown), through the boss 846, and into the firearm slide socket 122 once the mounting plate 824 is set onto the firearm slide 102. In other examples, the boss 846 may not have an aperture.

The mounting plate 824 can include one or more apertures 854 disposed on the optical base surface 842. In one example, the apertures 854 can be disposed on the optical base surface 842 to receive a fastener that secures the mounting plate 824 to the firearm slide 102 before an optic is set into place on the optical base surface 842. The anchor 836 can include one or more apertures 854 that can receive a fastener that secures the mounting plate 824 to the firearm slide 102 with or without an optic set into place. In other examples, the apertures 854 can be disposed anywhere along the mounting plate 824.

In some examples, the mounting plate 824 is substantially rectangular. For example, the mounting plate 824 can include a rectangular perimeter 834, a first plate wall 840A, and a second plate wall 840B. The plate walls 840A/840B can be at a 90-degree angle to an optic base surface 842. One or both of the plate walls 840A/840B can be straight or curved. In one example, the second plate wall 840B is a rectangular planar shape and the first plate wall 840A is a curved rectangular shape. In other examples, the plate walls 840A/840B may be triangular, circular, pyramidal, trapezoidal, or some other shape or combination of shapes. In other examples, the mounting plate 824 may be a different shape. For example, the plate walls 840A/840B may have an angle to the optic base surface 842 ranging from 1 degree to 179 degrees. The plate walls 840A/840B may be at the same or different angles from the optic base surface 842.

Figure 11:
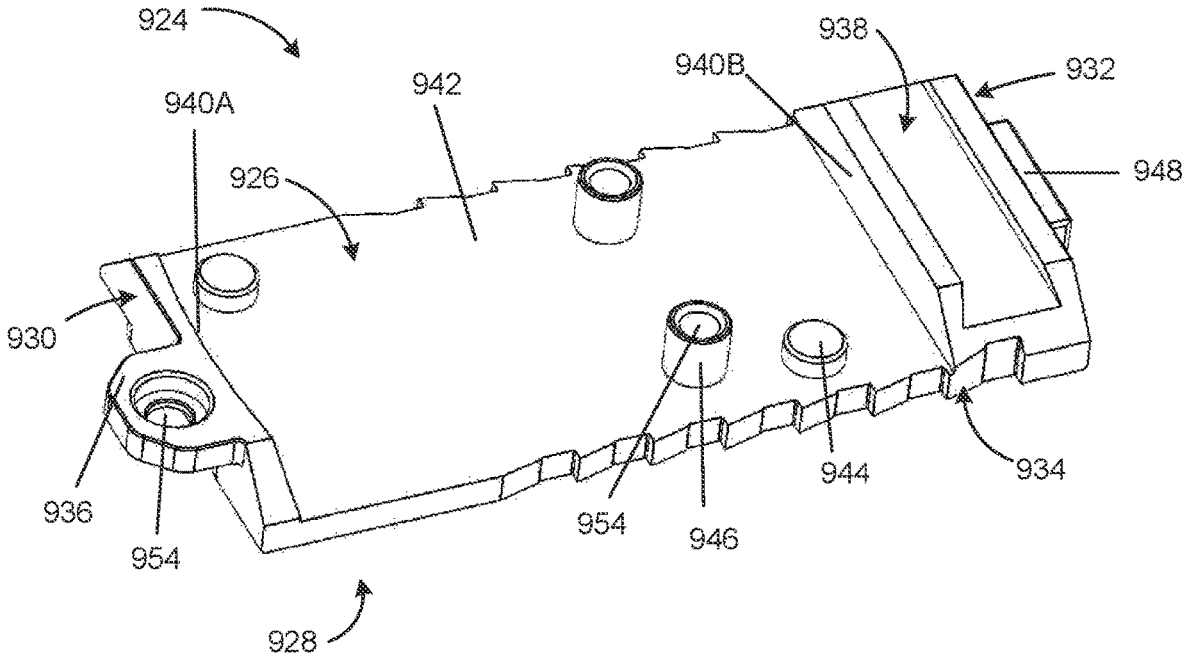
FIG. 11 is a perspective view of a mounting plate according to one or more examples of the disclosure.

FIG. 11 depicts a mounting plate 924 configured to secure into the firearm slide recess 110. In one example, the mounting plate 924 includes a top surface 926, an opposed bottom surface 928, a front side 930, and a rear side 932. Each surface may be configured for several purposes, including temporarily or permanently attaching the mounting plate 924 to a firearm or optic. As described below, the mounting plate 924 is configured to mount to a firearm slide 102. For example, the bottom surface 928 may be disposed within the recess 110 of the slide 102 and abut the base surface 115 of the recess 110. The mounting plate 924 enables a user to quickly change red dot sights and/or iron sights, and/or the configuration of the two (e.g., which is in front of the other), on a firearm slide 102.

FIG. 11 is a perspective view of the mounting plate 924 according to one example. The mounting plate 924 includes an anchor 936 disposed on the front side 930 and a stud 948 disposed on the rear side 932. As the mounting plate 924 is lowered into the recess 110, the stud 948 can enter the slot 116 disposed within the recess 110 thereby securing the rear side 932 of the plate. In some examples, the anchor 936 is configured to engage the catch 118 disposed on the firearm slide 102. Once engaged, the anchor 936 includes an aperture 954 through which a fastener secures the anchor 936 into the firearm slide 102 by engaging the socket 122 (e.g., as shown in FIG. 1). The anchor 936 and the stud 948 can thereby secure the mounting plate 924 within the recess 110 with or without an optic or iron sight thereby attached to the mounting plate 924.

The mounting plate 924 can include an optic base surface 942 with engagement components such as a sight joint 938, one or more tabs 944, and hollow bosses 946 disposed thereon. In one example, the sight joint 938 is disposed adjacent to the rear side 932 and a second plate wall 940B.

The sight joint 938 can be shaped like a dovetail sight joint and thereby secure a complementing iron sight. Along the optic base surface 942, between the first plate wall 940A and an opposing second plate wall 940B, the one or more tabs 944 may be disposed to engage a bottom surface of an optic (not shown). The tabs 944 can be shaped as semi-circular protrusions extending away from the optic base surface 942. In other examples, the tabs 944 can be circular, rectangular, triangular, or some other shape. Similarly, the optic base surface 942 can have one or more bosses 946 between the first plate wall 940A and the second plate wall 940B. The boss 946 can be hollow and include an aperture 954 to thereby receive a fastener. That is, the boss 946 can extend from the top surface 926 to the bottom surface 928 of the mounting plate 924. In some examples, the fastener may extend through the optic (not shown), through the boss 946, and into the firearm slide socket 122 once the mounting plate 924 is set onto the firearm slide 102. In other examples, the boss 946 may not have an aperture.

In some examples, the mounting plate 924 is substantially rectangular. For example, the mounting plate 924 can include a rectangular perimeter 934, a first plate wall 940A, and a second plate wall 940B. The plate walls 940A/940B can be at a 90-degree angle to an optic base surface 942. One or both of the plate walls 940A/940B can be straight or curved. In one example, the second plate wall 940B is a rectangular planar shape and the first plate wall 940A is curved rectangular shape. In other examples, the plate walls 940A/940B may be triangular, circular, pyramidal, trapezoidal, or some other shape or combination of shapes. In other examples, the mounting plate 924 may be a different shape. For example, the plate walls 940A/940B may have an angle to the optic base surface 942 ranging from 1 degree to 179 degrees. The plate walls 940A/940B may be at the same or different angles from the optic base surface 942.

Figure 12:
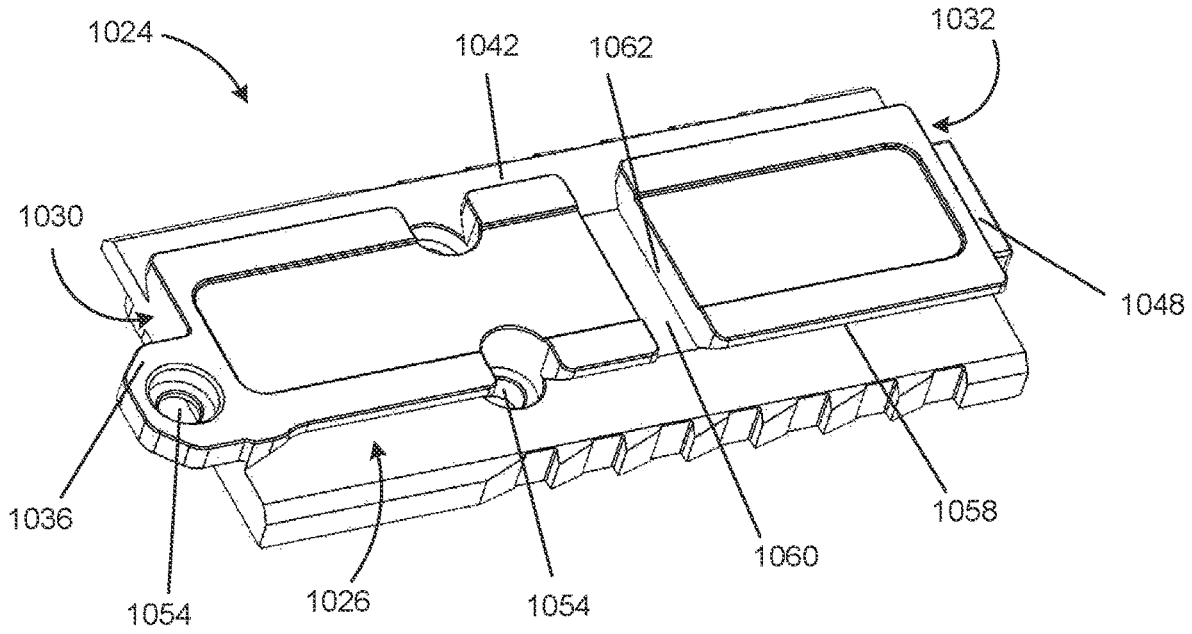
FIG. 12 is a perspective view of a mounting plate according to one or more examples of the disclosure.

FIG. 12 depicts a perspective view of a mounting plate 1024. The mounting plate 1024 includes an anchor 1036 disposed on a front side 1030 and a stud 1048 disposed on a rear side 1032. Between the front side 1030 and the rear side 1032 is at least one angled edge 1058. The angled edge(s) 1058 are configured to receive an optic through grappling onto the angled edge(s) 1058. In this manner, the angled edge 1058 can be a raised surface from the mounting plate 1024 through which the edge is angled away from the top surface 1026. Between the angled edges 1058 can be an intersecting channel 1060 configured to secure a portion of the optic. The intersection channel 1060 can include a set of parallel walls 1062 defining the channel. The mounting plate 1024 can include one or more apertures 1054 by which to receive fasteners therethrough.

The mounting plate 1024 can include one or more apertures 1054 disposed on the optical base surface 1042. In one example, the apertures 1054 can be disposed on the optical base surface 1042 to receive a fastener that secures the mounting plate 1024 to the firearm slide 102 before an optic is set into place on the optical base surface 1042. The anchor 1036 can include one or more apertures 1054 that can receive a fastener that secures the mounting plate 1024 to the firearm slide 102 with or without an optic set into place. In other examples, the apertures 1054 can be disposed anywhere along the mounting plate 1024.

Securing the Mounting Plate to the Firearm Slide

In some examples, with reference to FIGS. 1A and 1B, a method for mounting the mounting plate 124 on a firearm slide 102 is provided. The mounting plate 124 can be set into the recess 110 of the firearm slide 102 by first inserting the stud 148 into the slot 116 of the firearm slide 102. In some instances, the stud 148 can be inserted into the slot 116 at an angle. The mounting plate 124 may then be lowered so that the anchor 136 of the mounting plate 124 fits within a catch 118 of the firearm slide 102. For example, as seen in FIG. 1B, once the mounting plate 124 is set within the recess 110, a fastener (not shown) may be inserted into an aperture 154 of the anchor 136 into the socket 122 disposed within the catch 118 on the slide 102. The red dot sight may be set onto the mounting plate 124 before or after the mounting plate 124 is set within the recess 110. For example, the mounting plate 124 may be adapted to be attached to a red dot sight. The red dot sight may be an Aimpoint® Micro-optical sight, a DOCTER® red dot sight, a Leupold® Deltapoint, a Trijicon RMR®, or other sight having similar attachment mechanisms. A set of fasteners may operably screw through the red dot sight into the apertures 154 on the mounting plate 124.

In some examples, after the mounting plate 124 is set within the recess 110 of the firearm slide 102, and before the red dot sight is mounted to the mounting plate 124, several fasteners may operably secure the mounting plate 124 to the firearm slide 102 before the red dot sight is placed onto the mounting plate 124. For example, each of the apertures 154 on the mounting plate 124 may couple to a fastener, which, in turn, attaches to corresponding holes in the recess 110 of the firearm slide 102 to create a secure mounting. The red dot sight may be placed onto the mounting plate 124 before or after the mounting plate 124 is set within the recess 110 of the firearm slide 102. The mounting plate 124 may have one or more apertures 154. The mounting plate 124 may not have any apertures 154, or it may have one or more apertures 154.

One of the benefits to securing the mounting plate 124 using the anchor 136 without using the apertures 154 is the mounting plate 124 can be removed and/or exchanged for another mounting plate, perhaps with a different configuration or different red dot sight, quickly, with the removal of one screw via the aperture 154 of the anchor 136. Alternatively, one of the benefits to securing the mounting plate 124 using the apertures 154 before the red dot sight is mounted to the mounting plate 124 is to create a more secure mounting of the mounting plate 124 to the firearm slide.

Alternative Firearm Slide

Figure 13:
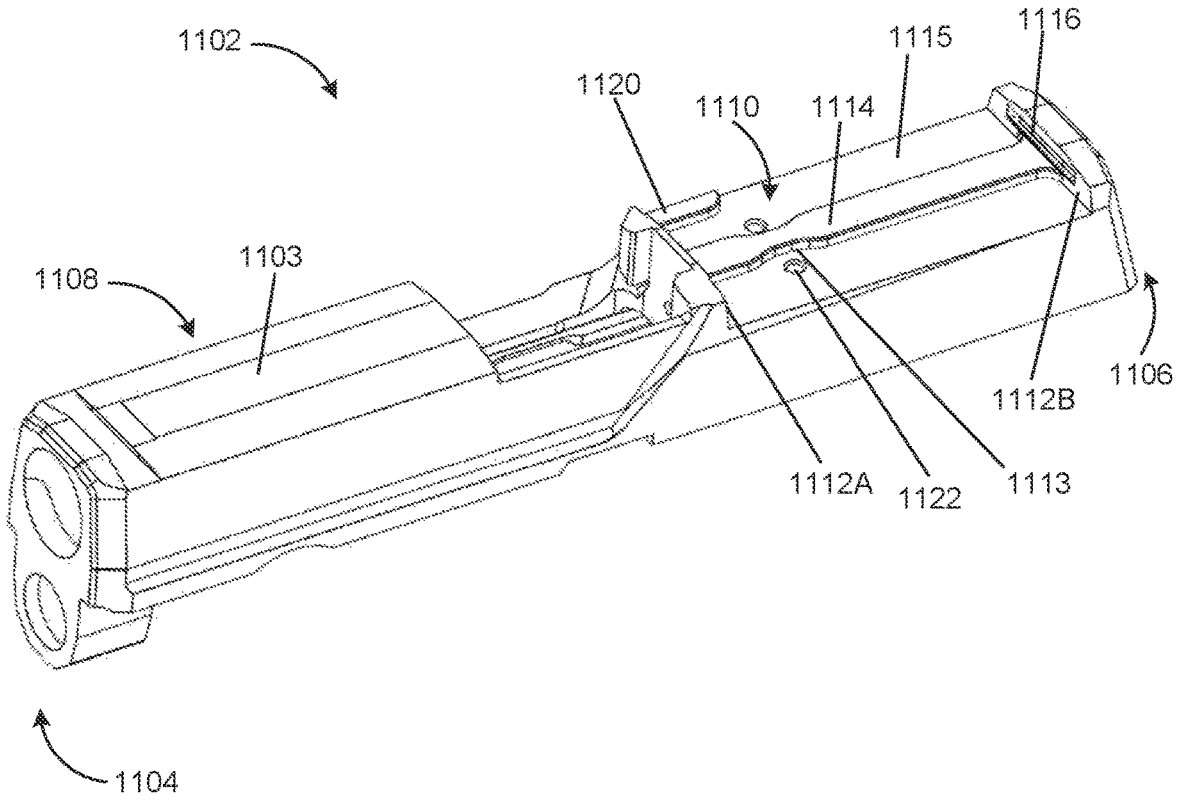
FIG. 13 is a perspective view of a firearm slide according to one or more examples of the disclosure.

FIG. 13 is a perspective view of a firearm slide according to one or more examples of the disclosure. The firearm slide 1102 may be constructed similar to the firearm slide 102, except that the firearm slide 1102 does not include a catch, e.g., catch 118. For example, as shown in FIG. 13, the firearm slide 1102 has a recess 1110 configured to accept a mounting plate, e.g., mounting plates 1224, 1324, 1424, 1524 described in further detail below. In certain examples, the firearm slide 1102 includes an exterior surface 1103 with a first side 1104 and a second side 1106. On a top side 1108 of the firearm slide 1102, between the first side 1104 and the second side 1106, the recess 1110 is disposed towards the second side 1106. The recess 1110 can be a recessed surface along the plane of the top side 1108 of the firearm slide 1102.

The recess 1110 of the firearm slide 1102 includes a pair of slide walls 1112A/1112B (e.g., a first slide wall 1112A and a second slide wall 1112B) disposed opposite to one another. In one example, the slide walls 1112A/1112B are parallel to one another and form a rectangular indention with the recess 1110. Adjacent to the first slide wall 1112A and extending to the second slide wall 1112B can be a rib 1114 disposed within the recess 1110. The rib 1114 can run between the first slide wall 1112A and the second slide wall 1112B. The rib 1114 can be a raised surface from a recess base surface 1115 configured to correspond to a later discussed surface of a mounting plate 1224, 1324, 1424, 1524. As shown in FIG. 13, the rib 1114 may have indentations 1113 that correspond with protrusions 1256, 1356, 1456, 1556 as described in further detail below. In other examples, the rib 1114 may extend in a variety of other directions and/or take other shapes, such as a square, circle, triangle, etc., or a combination shape.

Adjacent to the rib 1114, and disposed on the second slide wall 1112B, can be a slot 1116. The slot 1116 can be an indented surface disposed into the second slide wall 1112B. In other examples, the rib 1114, and the slot 1116 can be interchangeably disposed on or between the first slide wall 1112A and the second slide wall 1112B.

In some examples, the recess 1110 can include an ejector projection 1120 and one or more sockets 1122 disposed in the recess 1110. The ejector projection 1120 can be adjacent to the rib 1114, and similar to the rib 1114, the ejector projection 1120 can mimic a later discussed surface of the mounting plate. For example, the ejector projection 1120 may fit within a complementary ejector notch 1250 (see, e.g., FIG. 14B) on the bottom surface 1228 of the mounting plate 1224. Each the rib 1114 and the ejector projection 1120 can stabilize the mounting plate 1124 so as to disallow lateral movement whether the firearm is discharged or is static. Additionally, an advantage of the rib 1114 and the ejector projection 1120 can be to help to align the mounting plate 1124 between the first side 1104 and the second side 1106 of the firearm slide 1102. The rib 1114 may be raised at a variety of heights from the base surface 1115 of the recess 1110 of the firearm slide 1102. In some instances, the rib 1114 may be raised above the recess 1110 to protect the striker channel within the firearm slide 1102. In other examples, the rib 1114 can be omitted.

In some examples, the sockets 1122 can be disposed throughout and adjacent to the recess 1110. The sockets 1122 can be configured to receive one or more fasteners (e.g., threaded). For example, as shown in FIG. 13, the recess 1110 can include one or more sockets 1122. The recess 1110 can have a socket 1122 disposed on each side of the rib 1114. In this manner, once the mounting plate is set within the recess 1110, one or more fasteners can engage each socket 1122 through the mounting plate 1124.

In some instances, the recess 1110 can be substantially rectangular. For example, the two opposed slide walls 1112A/1112B extend at a 90-degree angle from the recess base surface 1115 towards the top side 1108 of the firearm slide 1102. In other examples, the recess 1110 may be circular, triangular, or some other geometric shape. The slide walls 11112A/112B may angle from the recess base surface 1115 between 1 degree to 179 degrees. In other examples, the slide walls 1112A/112B may include an arced surface. The slide walls 1112A/1112B may be at the same angle. In some instances, the recess base surface 1115 may be parallel (or co-planar) with the barrel hood of the firearm along the top side 1108 of the firearm slide 1102. In other instances, the recess base surface 1115 may be angled towards or away from the barrel hood of the firearm.

The firearm plate mounting assembly can alter between a disengaged position and an engaged position. In the disengaged position, the mounting plate 1224, 1324, 1424, 1524 can lower into the recess 1110 to secure onto the slide 1102 to be in the engaged position.

Mounting Plate

Figure 14A:
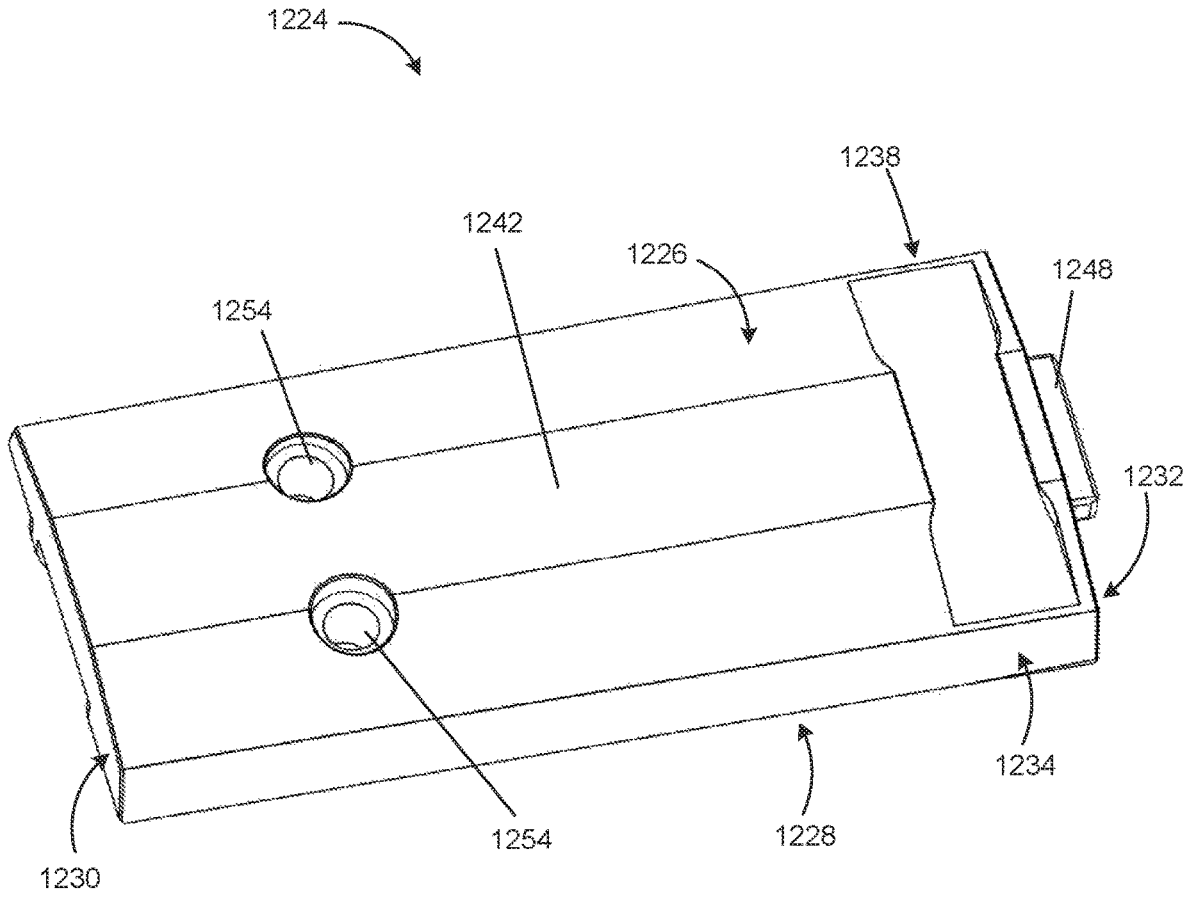
FIG. 14A is a perspective top view of a mounting plate according to one or more examples of the disclosure.
Figure 14B:
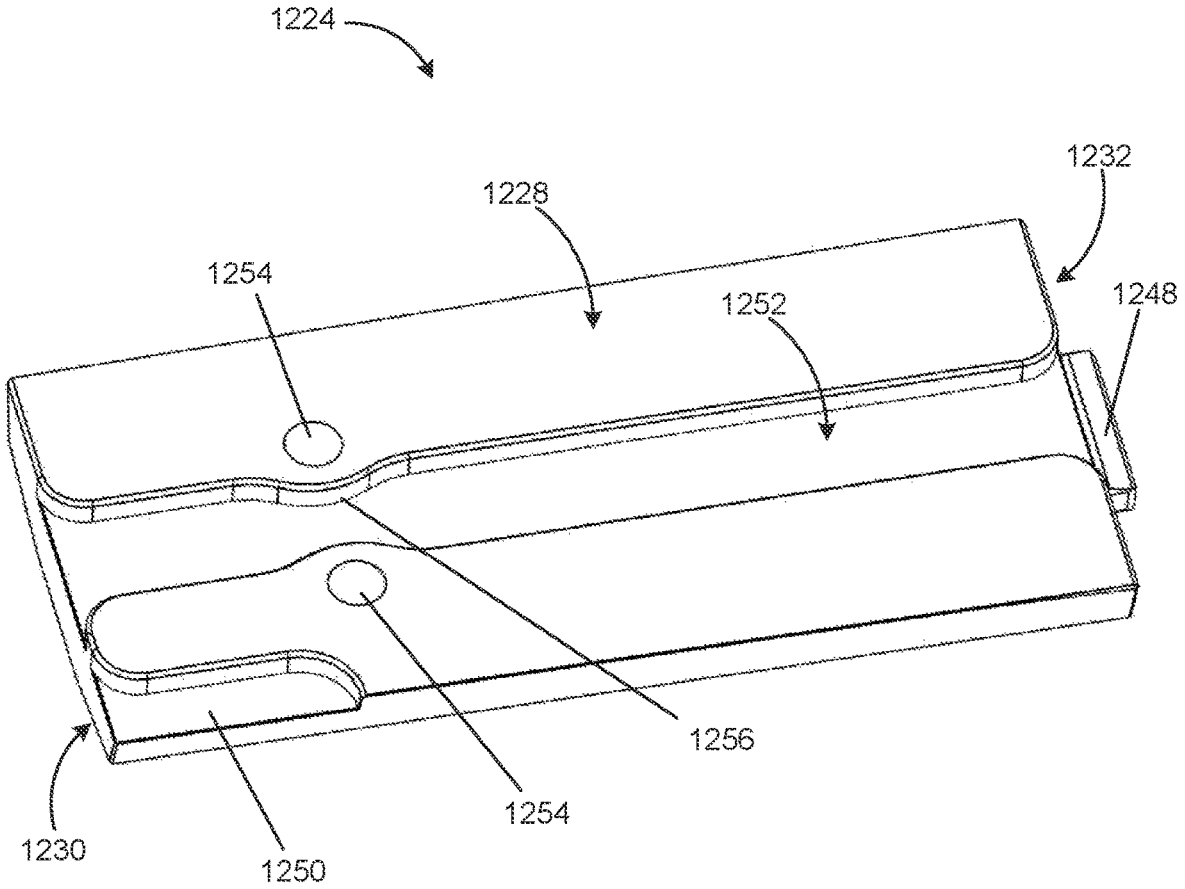
FIG. 14B is a perspective bottom view of a mounting plate according to one or more examples of the disclosure.

FIGS. 14A and 14B depicts various views of a mounting plate 1224 configured to secure into the firearm slide recess 1110. The mounting plate 1224 may be constructed similar to the mounting plate 324, except that the mounting plate 1224 does not include, e.g., an anchor, e.g., anchor 336. In one example, the mounting plate 1224 includes a top surface 1226, an opposed bottom surface 1228, a front side 1230, and a rear side 1232. Each surface may be configured for several purposes, including temporarily or permanently attaching the mounting plate 1224 to a firearm or optic. As described below, the mounting plate 1224 is configured to mount to a firearm slide 1102. For example, the bottom surface 1228 may be disposed within the recess 1110 of the slide 1102 and abut the base surface 1115 of the recess 1110. The mounting plate 1224 enables a user to quickly change red dot sights and/or iron sights, and/or the configuration of the two (e.g., which is in front of the other), on a firearm slide 1102.

FIG. 14A is a perspective top view of the mounting plate 1224 according to one example. The mounting plate 1224 includes a stud 1248 disposed on the rear side 1232. As the mounting plate 1224 is lowered into the recess 1110, the stud 1248 can enter the slot 1116 disposed within the recess 1110 thereby securing the rear side 1232 of the plate.

The mounting plate 1224 can include an optic base surface 1242 with engagement components such as a sight joint 1238, and one or more apertures 1254 extending therethrough. In one example, the sight joint 1238 is disposed adjacent to the rear side 1232. The sight joint 1238 can be shaped like a dovetail sight joint and thereby secure a complementing iron sight. The optic base surface 1242 can have one or more apertures 1254 between the front side 1230 and the rear side 1232. The one or more apertures 1254 described herein may be placed anywhere along the optic base surface 1242 and align with sockets disposed on the firearm slide. The apertures 1254 may receive a fastener. That is, the apertures 1254 can extend from the top surface 1226 to the bottom surface 1228 of the mounting plate 1224. In some examples, the fastener may extend through the optic (not shown), through the boss 1246, and into the firearm slide socket 1122 once the mounting plate 1224 is set onto the firearm slide 1102. In other examples, the apertures 1254 may not be extending completely through the mounting plate 1224.

In some examples, the mounting plate 1224 is substantially rectangular. For example, the mounting plate 1224 can include a rectangular perimeter 1234. In other examples, the mounting plate 1224 may be a different shape.

Referring to FIG. 14B, the mounting plate 1224 can include an ejector notch 1250 and a channel 1252 on the bottom surface 1228 configured to engage the firearm slide recess 1110. In one example, the ejector notch 1250 complements the shape of the ejector projection 1120 disposed within the recess 1110. Similarly, the channel 1252 can complement the shape of the rib 1114 disposed within the recess 1110. For example, the channel 1252 may include protrusions 1256 that correspond with indentations 1113 of the rib 1114. Both the ejector notch 1250 and the channel 1252 can slideably engage the ejector projection 1120 and the rib 1114, respectively. In some examples, the ejector notch 1250 can be disposed adjacent to the front side 1230. The channel 1252 can extend from the front side 1230 to the rear side 1232. In other examples, the ejector notch 1250 and the channel 1252 can be disposed or extend along any portion of the mounting plate 1224.

In some examples, the apertures 1254 are flush with the top surface 1226 of the mounting plate 1224 or may protrude in other suitable directions. For example, the plurality of apertures 1254 may protrude from the bottom surface 1228 of the mounting plate. The plurality of apertures 1254 may protrude or be flush with any other surface of the mounting plate 1224. Each of the apertures 1254 can include a threaded interior. The threaded interior accepts a fastener configured to secure the mounting plate 1224 to the firearm slide 1102. In some examples, the apertures 1254 are sized to accept an eight gauge, 40 thread per inch screw. The screw may include Loctite® screw glue on the surface to secure the mounting plate 1224. In other instances, the plurality of apertures 1254 may accept different sized screws or other fasteners. For example, the plurality of apertures 1254 may accept screw sizes from a 0 gauge to a 24 gauge screw. The screws and the complementary threading within the plurality of apertures may have a thread count of 1-100 threads per inch of the surface. The apertures 1254 may be disposed on any of the examples described herein.

Figure 15A:
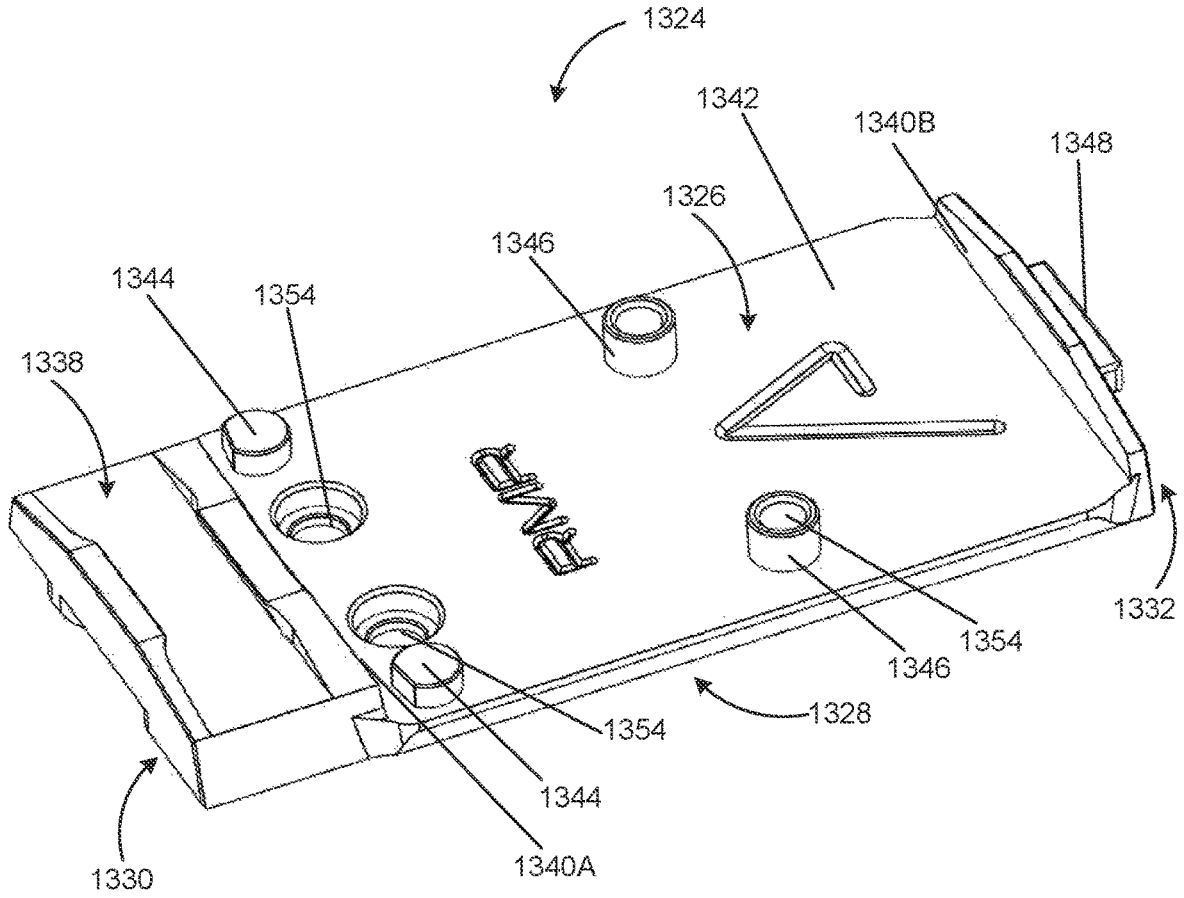
FIG. 15A is a perspective top view of a mounting plate according to one or more examples of the disclosure.
Figure 15B:
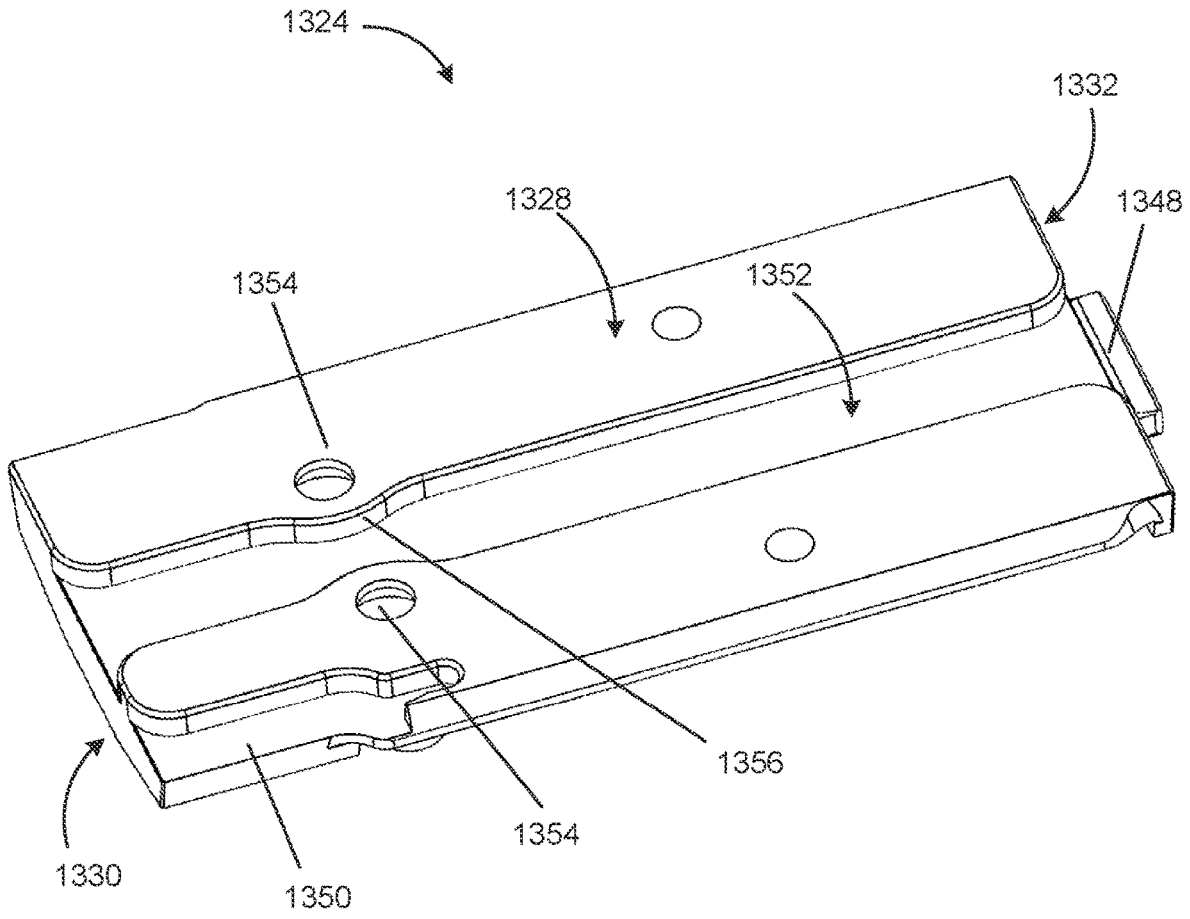
FIG. 15B is a perspective bottom view of a mounting plate according to one or more examples of the disclosure.

FIG. 15A is a perspective top view of a mounting plate according to one or more examples of the disclosure. FIG. 15B is a perspective bottom view of the mounting plate according to one or more examples of the disclosure. The mounting plate 1324 may be constructed similar to the mounting plate 424, except that the mounting plate 1324 does not include, e.g., an anchor, e.g., anchor 436. Referring to FIG. 15A, the mounting plate 1324 includes a top surface 1326, an opposed bottom surface 1328, a front side 1330, and a rear side 1332. Each surface may be configured for several purposes, including temporarily or permanently attaching the mounting plate 1324 to a firearm or optic. As described below, the mounting plate 1324 is configured to mount to a firearm slide 1102. For example, the bottom surface 1328 may be disposed within the recess 1110 of the slide 1102 and abut the base surface 1115 of the recess 1110 (e.g., as shown in FIG. 13). The mounting plate 1324 enables a user to quickly change red dot sights and/or iron sights, and/or the configuration of the two (e.g., which is in front of the other), on a firearm slide 1102.

The mounting plate 1324 includes a stud 1348 disposed on the rear side 1332. As the mounting plate 1324 is lowered into the recess 1110, the stud 1348 can enter the slot 1116 disposed within the recess 1110 thereby securing the rear side 1332 of the plate.

The mounting plate 1324 can include an optic base surface 1342 with engagement components such as a sight joint 1338, one or more tabs 1344, and hollow bosses 1346 disposed thereon. In one example, the sight joint 1338 is disposed adjacent to the rear side 1332 and a second plate wall 1340B. The sight joint 1338 can be shaped like a dovetail sight joint and thereby secure a complementing iron sight. Along the optic base surface 1342, between the first plate wall 1340A and an opposing second plate wall 1340B, the one or more tabs 1344 may be disposed to engage a bottom surface of an optic (not shown). The tabs 1344 can be shaped as semi-circular protrusions extending away from the optic base surface 1342. In other examples, the tabs 1344 can be circular, rectangular, triangular, or some other shape. Similarly, the optic base surface 1342 can have one or more bosses 1346 between the first plate wall 1340A and the second plate wall 1340B. The boss 1346 can be hollow and include an aperture 1354 to thereby receive a fastener. That is, the boss 1346 can extend from the top surface 1326 to the bottom surface 1328 of the mounting plate 1324. In some examples, the fastener may extend through the optic (not shown), through the boss 1346, and into the firearm slide socket 1122 once the mounting plate 1324 is set onto the firearm slide 1102. In other examples, the boss 1346 may not have an aperture.

The mounting plate 1324 can include one or more apertures 1354 disposed on the optical base surface 1342. In one example, the apertures 1354 can be disposed on the optical base surface 1342 to receive a fastener that secures the mounting plate 1324 to the firearm slide 1102 before an optic is set into place on the optical base surface 1342. In other examples, the apertures 1354 can be disposed anywhere along the mounting plate 1324.

In some examples, the mounting plate 1324 is substantially rectangular. For example, the mounting plate 1324 can include a rectangular perimeter 1334, a first plate wall 1340A, and a second plate wall 1340B. The plate walls 1340A/1340B can be at a 90-degree angle to an optic base surface 1342. One or both of the plate walls 1340A/1340B can be straight or curved. In one example, the second plate wall 1340B is a rectangular planar shape and the first plate wall 1340A is a curved rectangular shape. In other examples, the plate walls 1340A/1340B may be triangular, circular, pyramidal, trapezoidal, or some other shape or combination of shapes. In other examples, the mounting plate 1324 may be a different shape. For example, the plate walls 1340A/1340B may have an angle to the optic base surface 1342 ranging from 1 degree to 179 degrees. The plate walls 1340A/1340B may be at the same or different angles from the optic base surface 1342.

Referring to FIG. 15B, the mounting plate 1324 can include an ejector notch 1350 and a channel 1352 on the bottom surface 1328 configured to engage the firearm slide recess 1110. In one example, the ejector notch 1350 complements the shape of the ejector projection 1120 disposed within the recess 1110. Similarly, the channel 1352 can complement the shape of the rib 1114 disposed within the recess 1110. For example, the channel 1352 may include protrusions 1356 that correspond with indentations 1113 of the rib 1114. Both the ejector notch 1350 and the channel 1352 can slideably engage the ejector projection 1120 and the rib 1114, respectively. In some examples, the ejector notch 1350 can be disposed adjacent to the front side 1330. The channel 1352 can extend from the front side 1330 to the rear side 1332. In other examples, the ejector notch 1350 and the channel 1352 can be disposed or extend along any portion of the mounting plate 1324.

Figure 16A:
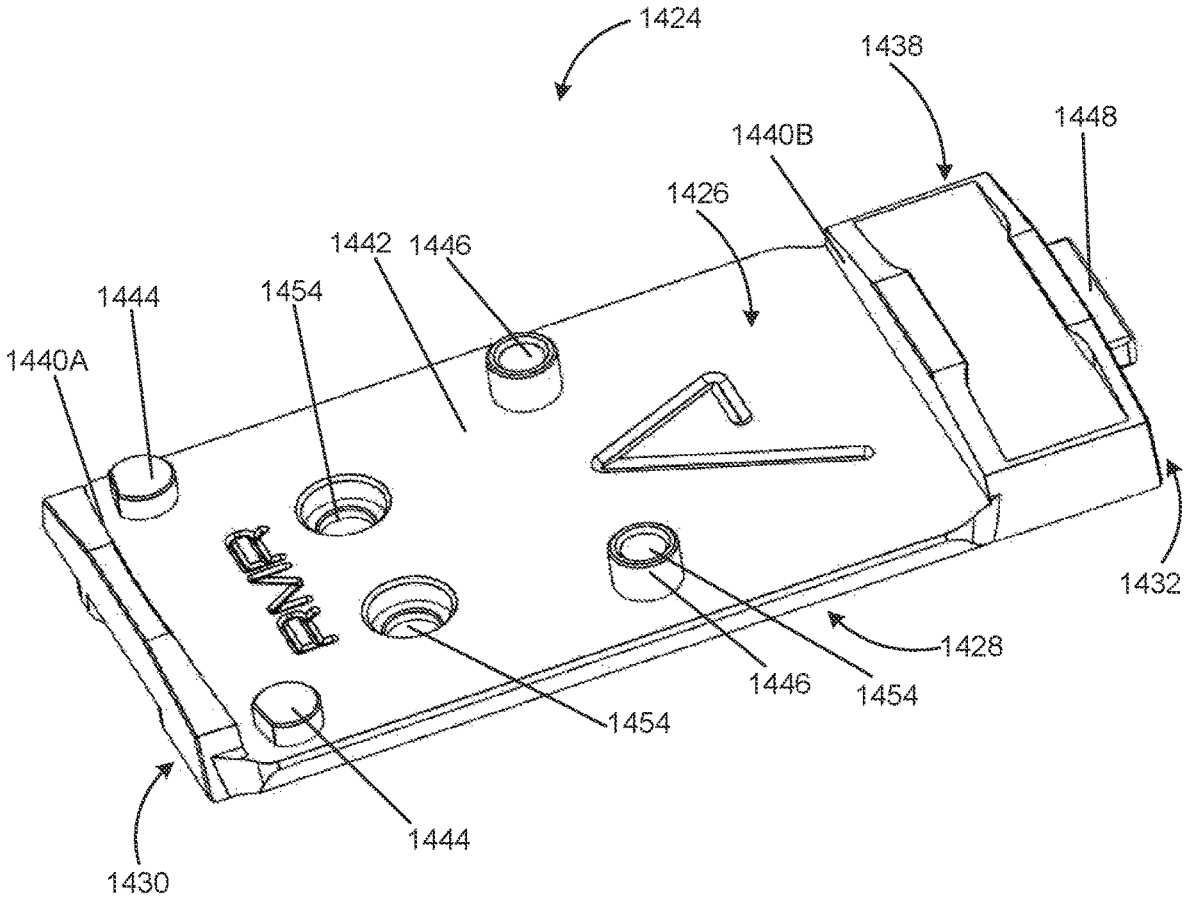
FIG. 16A is a perspective top view of a mounting plate according to one or more examples of the disclosure.
Figure 16B:
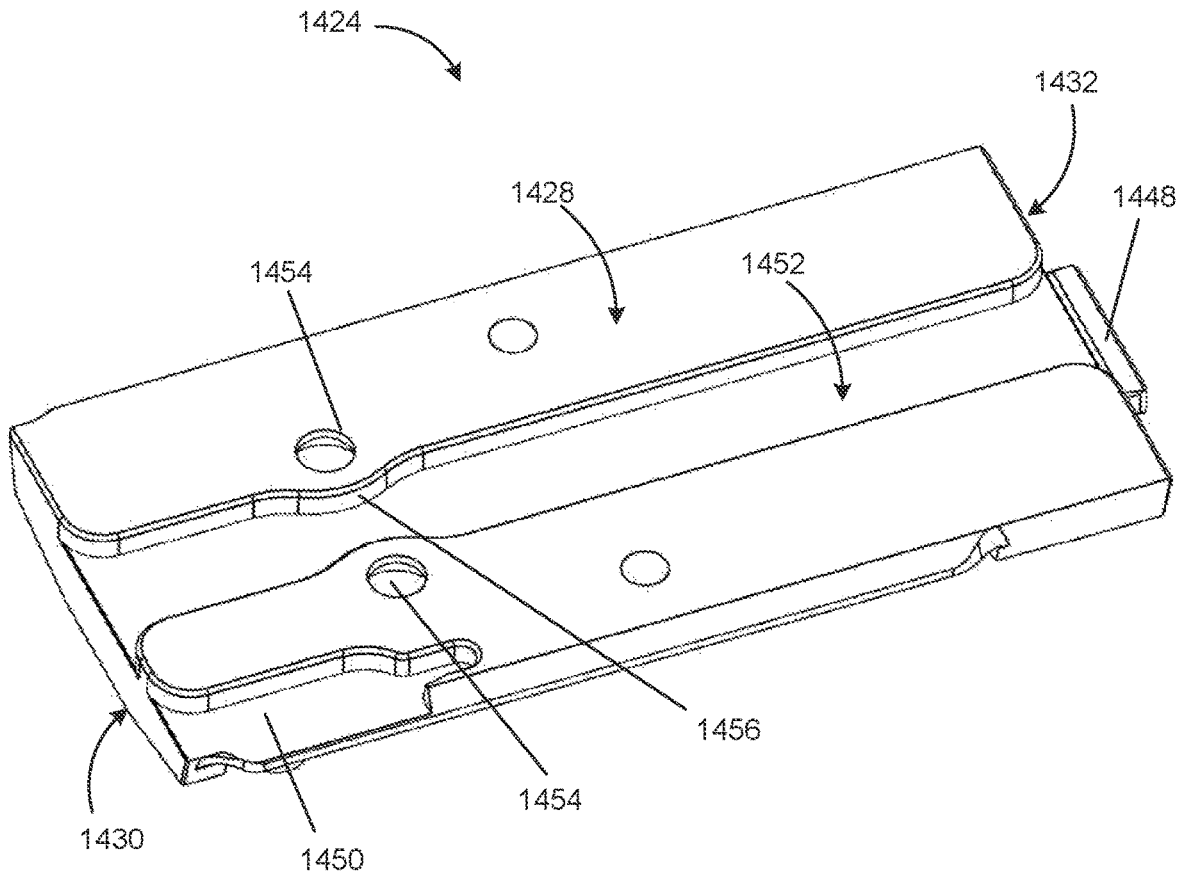
FIG. 16B is a perspective bottom view of a mounting plate according to one or more examples of the disclosure.

FIG. 16A is a perspective top view of a mounting plate according to one or more examples of the disclosure. FIG. 16B is a perspective bottom view of the mounting plate according to one or more examples of the disclosure. The mounting plate 1424 may be constructed similar to the mounting plate 224, except that the mounting plate 1424 does not include, e.g., an anchor, e.g., anchor 236. Referring to FIG. 16A, the mounting plate 1424 includes a top surface 1426, an opposed bottom surface 1428, a front side 1430, and a rear side 1432. Each surface may be configured for several purposes, including temporarily or permanently attaching the mounting plate 1424 to a firearm or optic. As described below, the mounting plate 1424 is configured to mount to a firearm slide 1102. For example, the bottom surface 1428 may be disposed within the recess 1110 of the slide 1102 and abut the base surface 1115 of the recess 1110 (e.g., as shown in FIG. 1). The mounting plate 1424 enables a user to quickly change red dot sights and/or iron sights, and/or the configuration of the two (e.g., which is in front of the other), on a firearm slide 1102.

The mounting plate 1424 includes a stud 1448 disposed on the rear side 1432. As the mounting plate 1424 is lowered into the recess 1110, the stud 1448 can enter the slot 1116 disposed within the recess 1110 thereby securing the rear side 1432 of the plate.

The mounting plate 1424 can include an optic base surface 1442 with engagement components such as a sight joint 1438, one or more tabs 1444, and hollow bosses 1446 disposed thereon. In one example, the sight joint 1438 is disposed adjacent to the rear side 1432 and a second plate wall 1440B. The sight joint 1438 can be shaped like a dovetail sight joint and thereby secure a complementing iron sight. Along the optic base surface 1442, between the first plate wall 1440A and an opposing second plate wall 1440B, the one or more tabs 1444 may be disposed to engage a bottom surface of an optic (not shown). The tabs 1444 can be shaped as semi-circular protrusions extending away from the optic base surface 1442. In other examples, the tabs 1444 can be circular, rectangular, triangular, or some other shape. Similarly, the optic base surface 1442 can have one or more bosses 1446 between the first plate wall 1440A and the second plate wall 1440B. The boss 1446 can be hollow and include an aperture 1454 to thereby receive a fastener. That is, the boss 1446 can extend from the top surface 1426 to the bottom surface 1428 of the mounting plate 1424. In some examples, the fastener may extend through the optic (not shown), through the boss 246, and into the firearm slide socket 1122 once the mounting plate 1424 is set onto the firearm slide 1102. In other examples, the boss 1446 may not have an aperture. A channel 1452 can be disposed along the bottom surface 1428 configured to engage the recess 1110.

The mounting plate 1424 can include one or more apertures 1454 disposed on the optical base surface 1442. In one example, the apertures 1454 can be disposed on the optical base surface 1442 to receive a fastener that secures the mounting plate 1424 to the firearm slide 1102 before an optic is set into place on the optical base surface 1442. In other examples, the apertures 1454 can be disposed anywhere along the mounting plate 1424.

In some examples, the mounting plate 1424 is substantially rectangular. For example, the mounting plate 1424 can include a rectangular perimeter 1434, a first plate wall 1440A, and a second plate wall 1440B. The plate walls 1440A/1440B can be at a 90-degree angle to an optic base surface 1442. One or both of the plate walls 1440A/1440B can be straight or curved. In one example, the second plate wall 1440B is a rectangular planar shape and the first plate wall 1440A is curved rectangular shape. In other examples, the plate walls 1440A/1440B may be triangular, circular, pyramidal, trapezoidal, or some other shape or combination of shapes. In other examples, the mounting plate 1424 may be a different shape. For example, the plate walls 1440A/1440B may have an angle to the optic base surface 1442 ranging from 1 degree to 179 degrees. The plate walls 1440A/1440B may be at the same or different angles from the optic base surface 1442.

Referring to FIG. 16B, the mounting plate 1424 can include an ejector notch 1450 and a channel 1452 on the bottom surface 1428 configured to engage the firearm slide recess 1110. In one example, the ejector notch 1450 complements the shape of the ejector projection 1120 disposed within the recess 1110. Similarly, the channel 1452 can complement the shape of the rib 1114 disposed within the recess 1110. For example, the channel 1452 may include protrusions 1456 that correspond with indentations 1113 of the rib 1114. Both the ejector notch 1350 and the channel 1452 can slideably engage the ejector projection 1120 and the rib 1114, respectively. In some examples, the ejector notch 1450 can be disposed adjacent to the front side 1430. The channel 1452 can extend from the front side 1430 to the rear side 1432. In other examples, the ejector notch 1450 and the channel 1452 can be disposed or extend along any portion of the mounting plate 1424.

Figure 17A:
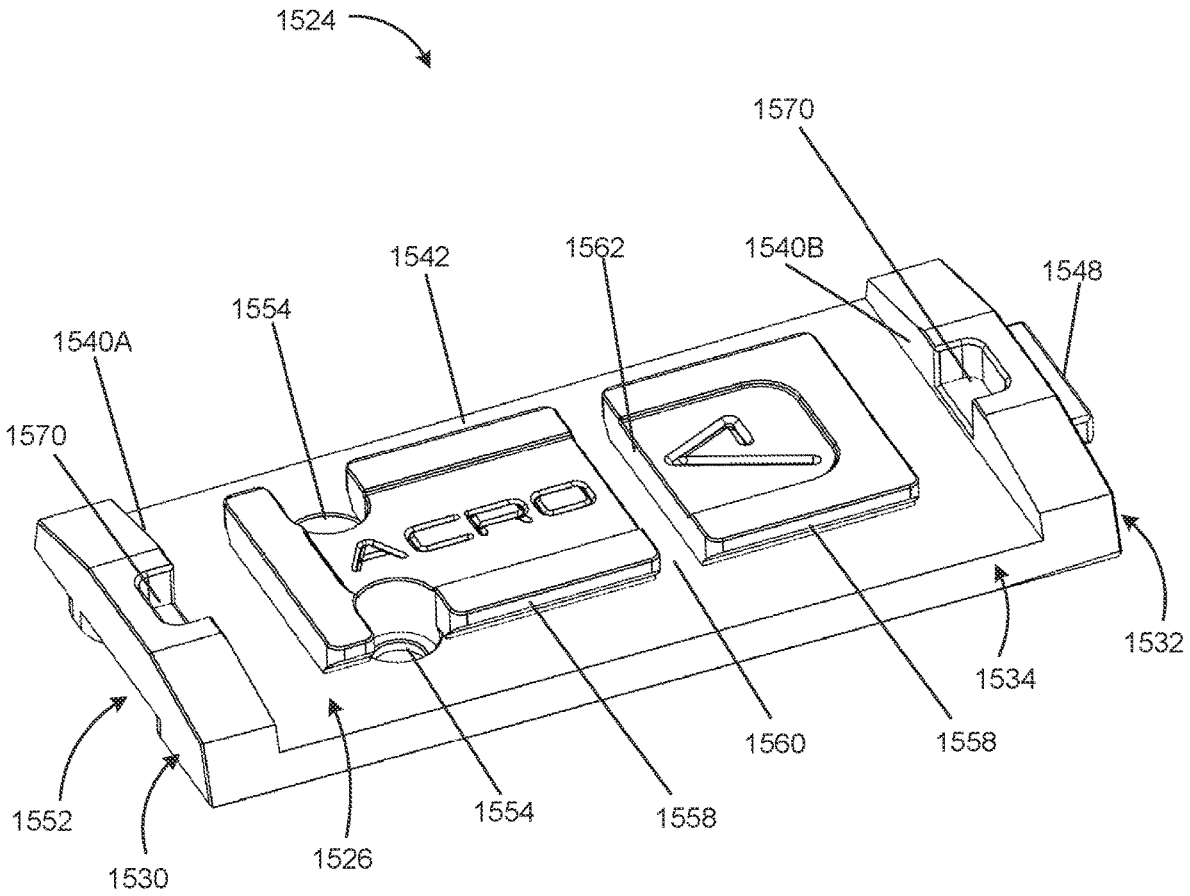
FIG. 17A is a perspective top view of a mounting plate according to one or more examples of the disclosure.
Figure 17B:
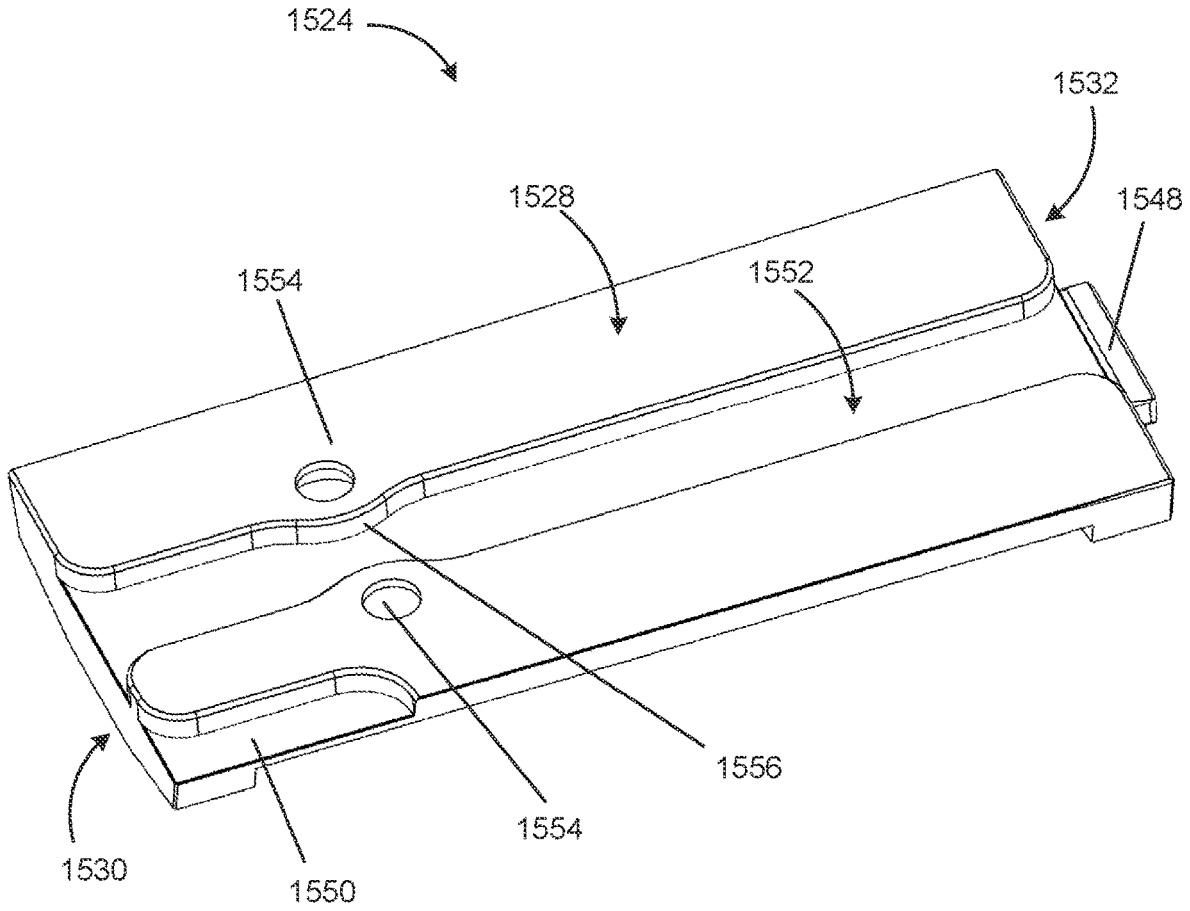
FIG. 17B is a perspective bottom view of a mounting plate according to one or more examples of the disclosure.

FIG. 17A is a perspective top view of a mounting plate according to one or more examples of the disclosure. FIG. 17B is a perspective bottom view of the mounting plate according to one or more examples of the disclosure. The mounting plate 1524 may be constructed similar to the mounting plate 1024, except that the mounting plate 1524 does not include, e.g., an anchor, e.g., anchor 1036. Referring to FIG. 17A, the mounting plate 1524 includes a stud 1548 disposed on a rear side 1532. Between the front side 1530 and the rear side 1532 is at least one angled edge 1558. The angled edge(s) 1558 are configured to receive an optic through grappling onto the angled edge(s) 1558. In this manner, the angled edge 1558 can be a raised surface from the mounting plate 1524 through which the edge is angled away from the top surface 1526. Between the angled edges 1558 can be an intersecting channel 1560 configured to secure a portion of the optic. The intersection channel 1560 can include a set of parallel walls 1562 defining the channel. The mounting plate 1524 can include one or more apertures 1554 by which to receive fasteners therethrough.

In some examples, the mounting plate 1524 is substantially rectangular. For example, the mounting plate 1524 can include a rectangular perimeter 1534, a first plate wall 1540A, and a second plate wall 1540B. As shown in FIG. 17A, mounting plate 1524 may include slots 1570 adjacent at one or both of the first plate wall 1540A or the second plate wall 1540B. The slots 1570 may be sized and shape to receive a corresponding structure on the attachment. The mounting plate 1524 can include one or more apertures 1554 disposed on the optical base surface 1542. In one example, the apertures 1554 can be disposed on the optical base surface 1542 to receive a fastener that secures the mounting plate 1524 to the firearm slide 1102 before an optic is set into place on the optical base surface 1542. In other examples, the apertures 1554 can be disposed anywhere along the mounting plate 1524.

Referring to FIG. 17B, the mounting plate 1524 can include an ejector notch 1550 and a channel 1552 on the bottom surface 1528 configured to engage the firearm slide recess 1110. In one example, the ejector notch 1550 complements the shape of the ejector projection 1120 disposed within the recess 1110. Similarly, the channel 1552 can complement the shape of the rib 1114 disposed within the recess 1110. For example, the channel 1552 may include protrusions 1556 that correspond with indentations 1113 of the rib 1114. Both the ejector notch 1350 and the channel 1552 can slideably engage the ejector projection 1120 and the rib 1114, respectively. In some examples, the ejector notch 1550 can be disposed adjacent to the front side 1530. The channel 1552 can extend from the front side 1530 to the rear side 1432. In other examples, the ejector notch 1550 and the channel 1552 can be disposed or extend along any portion of the mounting plate 1524.

Although specific examples of the disclosure have been described, numerous other modifications and alternative examples are within the scope of the disclosure. For example, any of the functionality described with respect to a particular device or component may be performed by another device or component. Further, while specific device characteristics have been described, examples of the disclosure may relate to numerous other device characteristics. Further, although examples have been described in language specific to structural features and/or methodological acts, it is to be understood that the disclosure is not necessarily limited to the specific features or acts described. Rather, the specific features and acts are disclosed as illustrative forms of implementing the examples. Conditional language, such as, among others, "can," "could," "might," or "may," unless specifically stated otherwise, or otherwise understood within the context as used, is generally intended to convey that certain examples could include, while other examples may not include, certain features, elements, and/or steps. Thus, such conditional language is not generally intended to imply that features, elements, and/or steps are in any way required for one or more examples.

We claim:

1. A mounting plate configured to attach to a slide of a firearm, the mounting plate comprising:

a top surface, an opposed bottom surface, a front side configured to face toward a front end of the firearm, and a rear side configured to face toward a rear end of the firearm;

a first plate wall adjacent to the front side of the mounting plate;

a second plate wall adjacent to the rear side of the mounting plate; and a first slot defined in the first plate wall and a second slot defined in the second plate wall and configured to receive corresponding structure of an optic, wherein the first slot and the second slot are symmetrically aligned with one another along a longitudinal axis of the mounting plate.

2. The mounting plate of claim 1, wherein the first plate wall and the second plate wall each extend above the top surface.

3. The mounting plate of claim 1, wherein:

the first slot extends from a rear surface of the first plate wall toward the front side of the mounting plate and from a top surface of the first plate wall toward the opposed bottom surface of the mounting plate; and the second slot extends from a front surface of the second plate wall toward the rear side of the mounting plate and from a top surface of the second plate wall toward the opposed bottom surface of the mounting plate.

4. The mounting plate of claim 1, further comprising a stud extending from the rear side of the mounting plate.

5. The mounting plate of claim 1, further comprising a plurality of angled edges each extending above the top surface and configured to engage corresponding structure of the optic.

6. The mounting plate of claim 5, further comprising an intersecting channel extending between a pair of the angled edges and configured to engage corresponding structure of the optic.

7. The mounting plate of claim 1, further comprising a channel disposed on the opposed bottom surface of the mounting plate, wherein the channel extends from the front side to the rear side of the mounting plate.

8. The mounting plate of claim 1, further comprising an ejector notch disposed on the opposed bottom surface of the mounting plate.

9. The mounting plate of claim 1, further comprising one or more apertures extending through the mounting plate from the top surface to the opposed bottom surface.

10. A firearm sight mounting plate assembly for a firearm, comprising:

a firearm slide comprising:

a top side, a first side configured to face toward a front end of the firearm, and a second side configured to face toward a rear end of the firearm;

a recess disposed on the top side of the firearm slide, the recess comprising:

a first slide wall, a second slide wall, and a recess base surface defining the recess; and a rib extending along the recess base surface;

a mounting plate configured to attach to the firearm slide, the mounting plate comprising:

a top surface, an opposed bottom surface, a front side configured to face toward the front end of the firearm, and a rear side configured to face toward the rear end of the firearm;

a first plate wall adjacent to the front side of the mounting plate;

a second plate wall adjacent to the rear side of the mounting plate;

a first slot defined in the first plate wall and a second slot defined in the second plate wall and configured to receive corresponding structure of an optic, wherein the first slot and the second slot are symmetrically aligned with one another along a longitudinal axis of the mounting plate; and a channel disposed on the opposed bottom surface of the mounting plate and configured to receive the rib.

11. The firearm sight mounting plate assembly of claim 10, wherein:

the first slot extends from a rear surface of the first plate wall toward the front side of the mounting plate and from a top surface of the first plate wall toward the opposed bottom surface of the mounting plate; and the second slot extends from a front surface of the second plate wall toward the rear side of the mounting plate and from a top surface of the second plate wall toward the opposed bottom surface of the mounting plate.

12. The firearm sight mounting plate assembly of claim 10, wherein:

the firearm slide further comprises a slide slot disposed within the recess; and the mounting plate further comprises a stud configured to engage the slide slot.

13. The firearm sight mounting plate assembly of claim 10, wherein:

the firearm slide further comprises an ejector projection disposed adjacent to the rib; and the mounting plate further comprises an ejector notch disposed on the opposed bottom surface of the mounting plate and configured to receive the ejector projection.

14. A firearm sight mounting plate assembly for a firearm, comprising:

a firearm slide comprising:

a top side, a first side configured to face toward a front end of the firearm, and a second side configured to face toward a rear end of the firearm;

a recess disposed on the top side of the firearm slide, the recess comprising:

a first slide wall, a second slide wall, and a recess base surface defining the recess; and a slide slot disposed within the recess;

a mounting plate configured to attach to the firearm slide, the mounting plate comprising:

a top surface, an opposed bottom surface, a front side configured to face toward the front end of the firearm, and a rear side configured to face toward the rear end of the firearm;

a first plate wall adjacent to the front side of the mounting plate;

a second plate wall adjacent to the rear side of the mounting plate;

a first slot defined in the first plate wall a second slot defined in the second plate wall and configured to receive corresponding structure of an optic, wherein the first slot and the second slot are symmetrically aligned with one another along a longitudinal axis of the mounting plate; and a stud configured to engage the slide slot.

15. The firearm sight mounting plate assembly of claim 14, wherein:

the first slot extends from a rear surface of the first plate wall toward the front side of the mounting plate and from a top surface of the first plate wall toward the opposed bottom surface of the mounting plate; and the second slot extends from a front surface of the second plate wall toward the rear side of the mounting plate and from a top surface of the second plate wall toward the opposed bottom surface of the mounting plate.

16. The firearm sight mounting plate assembly of claim 14, wherein:

the firearm slide further comprises a rib extending along the recess base surface; and the mounting plate further comprises a channel disposed on the opposed bottom surface of the mounting plate and configured to receive the rib.

17. The firearm sight mounting plate assembly of claim 16, wherein:

the firearm slide further comprises an ejector projection disposed adjacent to the rib; and the mounting plate further comprises an ejector notch disposed on the opposed bottom surface of the mounting plate and configured to receive the ejector projection.

* * * * *